United States Patent [19]

Johnson

[11] 4,015,515

[45] Apr. 5, 1977

[54] APPARATUS FOR INSERTING LINERS IN BAGS

[75] Inventor: Harold K. Johnson, Burnsville, Minn.

[73] Assignee: Bemis Company, Inc., Minneapolis, Minn.

[22] Filed: Apr. 16, 1976

[21] Appl. No.: 677,786

[52] U.S. Cl. ..... 93/8 W; 53/59 R; 53/175; 53/386

[51] Int. Cl.[2] ..... B31B 1/00

[58] Field of Search ..... 53/59 R, 175, 386; 93/8 R, 8 WA, 36.01, 8 W, 35 VL

[56] References Cited

UNITED STATES PATENTS

| | | | |
|---|---|---|---|
| 2,896,516 | 7/1959 | Tilton et al. | 93/36.01 X |
| 3,074,325 | 1/1963 | Schroeder | 93/8 WA |

*Primary Examiner*—Gerald A. Dost
*Assistant Examiner*—Paul A. Bell
*Attorney, Agent, or Firm*—Koenig, Senniger, Powers and Leavitt

[57] ABSTRACT

Apparatus for automatically inserting plastic liners in open-mouth multiwall paper bags having means for holding a stack of the bags to be lined, and means for opening the uppermost bag of the stack for insertion of a liner therein. Insertion is via an inserter having vacuum means for gripping a liner, the inserter moving forward into the opened bag at the top of the stack for inserting a liner grasped by the inserter into the bag. The inserter moves the lined bag forward to an outfeed position where an outfeed means engages the lined bag to feed it forward for being stacked and, with the grip on the liner released, the inserter is retracted for the next cycle of operation. Liners are supplied from a roll in which they are interconnected end-to-end in series at transverse lines of weakness, the leading liner of the series being torn off and fed into position for being gripped by the vacuum means of the inserter.

27 Claims, 32 Drawing Figures

APPARATUS FOR INSERTING LINERS IN BAGS

BACKGROUND OF THE INVENTION

This invention relates to apparatus for inserting liners in bags, and more particularly to apparatus for inserting liners each comprising a bag made of plastic film having a heat-sealed bottom end closure and an open mouth in open-mouth multiwall paper bags, such as pinch bottom open-mouth and sewn open-mouth multiwall paper bags.

The invention is in the same general field as the apparatus shown in U.S. Pat. No. 3,074,325.

SUMMARY OF THE INVENTION

Among the several objects of the invention may be noted the provision of improved apparatus for inserting liners in bags, and particularly for inserting plastic liners in open-mouth multiwall paper bags; the provision of such apparatus adapted automatically and efficiently to open the bags and insert the liners therein at increased production rates.

In general, apparatus of this invention comprises means for holding a stack of bags with the bags in the stack extending longitudinally of the apparatus and with the mouths of the bags in the stack directed toward one end of the apparatus constituting its rearward end, and means for gripping the upper wall of the uppermost bag of the stack and raising it to open this bag for insertion of a liner therein. The apparatus further comprises an inserter movable forward longitudinally of the apparatus from a rearward retracted position wherein its forward end is rearward of the mouth of the opened uppermost bag through a forward stroke above the stack holding means for entry of the inserter in the opened uppermost bag to insert a liner therein and for movement of the bag with the liner therein forward over the stack to an outfeed position wherein the forward end portion of the bag is forward of the stack. The inserter has means for gripping a liner for forward movement of the liner with the inserter ito the opened uppermost bag and the apparatus includes means for moving the inserter longitudinally of the apparatus through a forward stroke from its retracted position and then through a rearward return stroke back to its retracted position. Means is provided for feeding a liner from a supply thereof to bring the liner into position for being gripped by the gripping means for insertion of the liner in the opened uppermost bag. Outfeed means forward of the stack holding means is engageable with a lined bag in the outfeed position for feeding the lined bag forward. Means is provided for operating the gripping means to grip a liner fed into position for being gripped and for releasing the grip after insertion of the liner for retraction of the inserter without retraction of the liner.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
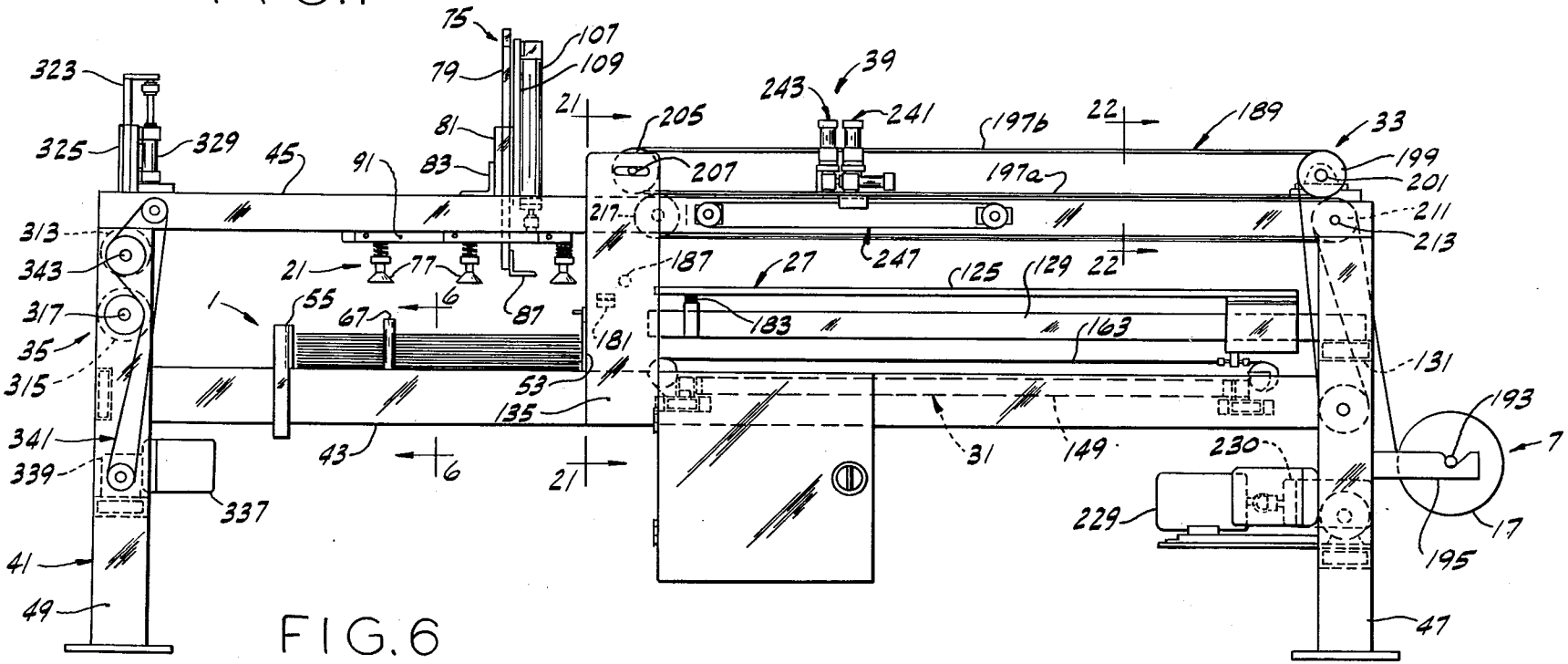
FIG. 1 is a side elevation of an apparatus of this invention for inserting liners in bags.

Referring to the drawings, first generally to FIGS. 1-4, apparatus made in accordance with this invention for inserting liners in bags is shown to comprise means indicated generally at 1 for holding a stack 3 of bags 5, and means indicated generally at 7 for holding a supply of liners 9 to be inserted in the bags 5. The latter are generally open-mouth multiwall paper bags, and may be of any suitable type for having a liner inserted therein, such as a multiwall pinch bottom open-mouth bag, or a multiwall sewn open-mouth bag. As to the bag 5, its bottom closure is indicated at 11 and its open mouth at 13. Each liner 9 is itself a bag made of heat-sealable plastic film (e.g., polyethylene film) having a heat-sealed bottom end closure 15 and an open mouth at its end opposite the bottom end closure seal 15. The liners 9 are supplied from a roll 17 in which they are interconnected end-to-end in a continuous series at transverse lines of weakness 19 (e.g., lines of perforations) each defining the mouth end of one liner and the bottom end of the next liner. The continuous series of liners is made in a conventional manner well-known in the art from seamless plastic tubing (e.g., polyethylene tubing) with the seals 15 spaced at liner length intervals and with the lines of weakness 19 (e.g., perforations) also spaced at liner length intervals and spaced from but adjacent the seals 15, and with the liners wound up into the roll with the lines of weakness 19 on the leading side of the seals 15 as the liners are unwound from the roll (see FIG. 5).

The means indicated generally at 1 for holding the stack 3 of bags 5 holds them with the bags in the stack extending longitudinally of the apparatus and with the mouths 13 of the bags in the stack directed toward one end of the apparatus constituting its rearward end, which is its right end as viewed in FIGS. 1–5. Thus, the bottom closure ends 11 of the bags B in the stack are directed toward the forward end of the apparatus, which is its left end as viewed in FIG. 1. At 21 is generally indicated means for gripping the upper wall 23 of the uppermost bag 5 of the stack 3 and raising it to separate it from the lower wall 25 of the bag to open the bag for insertion of a liner 9 therein.

Figure 2:
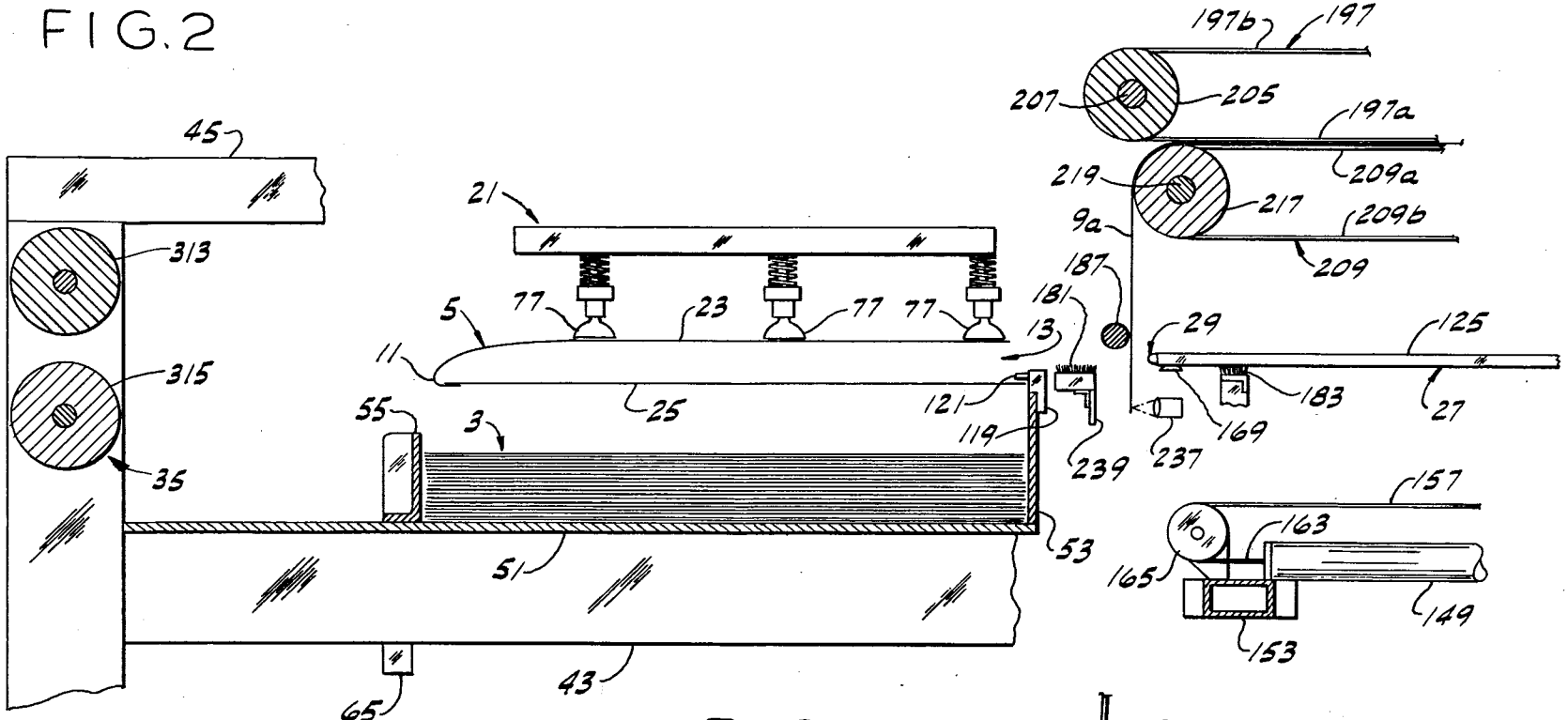
FIG. 2 is a semi-diagrammatic view, with parts shown in section, showing a bag opened up for insertion of a liner.
Figure 3:
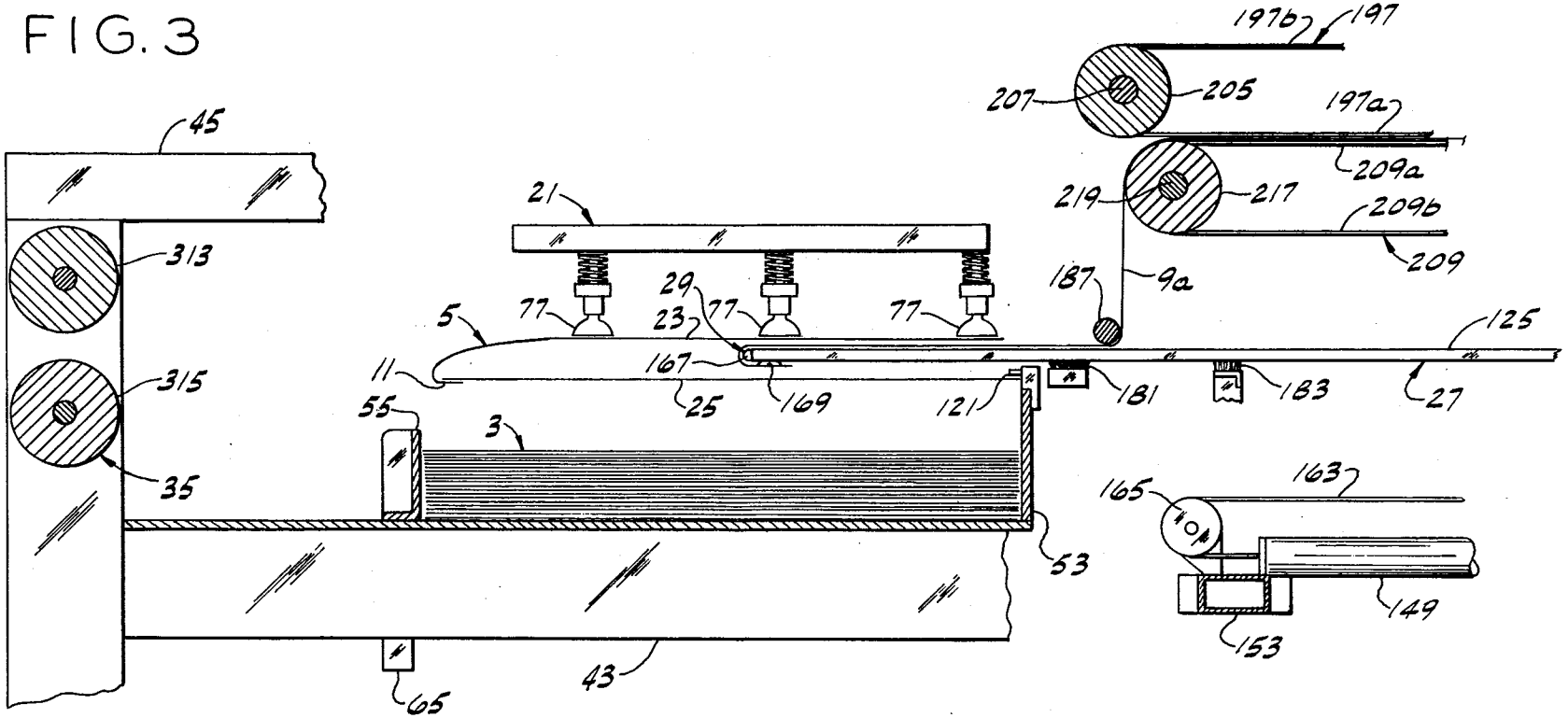
FIG. 3 is a view similar to FIG. 2 showing the liner partially inserted in the opened bag.
Figure 4:
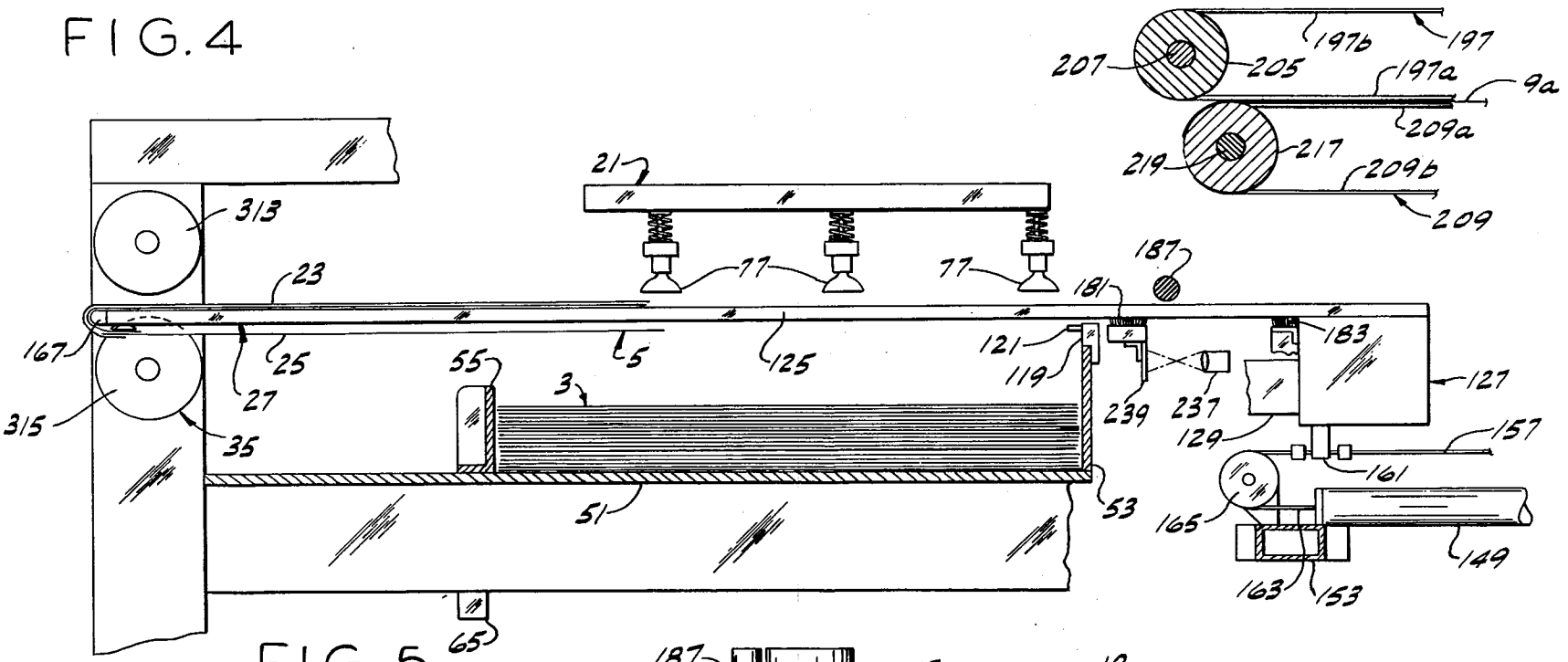
FIG. 4 is a view similar to FIGS. 2 and 3 showing the liner fully inserted in the bag and the bag with the liner therein (referred to as the "lined bag") moved to an outfeed position for being fed out of the apparatus.

At 27 is generally indicated an inserter or ram movable forward longitudinally of the apparatus from the rearward retracted position in which it is illustrated in FIGS. 1 and 2 wherein its forward (left-hand) end is rearward of the mouth of the opened uppermost bag 5 through a forward stroke (toward the left) above the stack holding means 1 for entry of the inserter in the opened uppermost bag 5 to insert a liner 9 therein (see FIG. 3) and for movement of the bag with the liner therein forward over the stack to an outfeed position wherein the forward end portion of the bag is forward of the stack (see FIG. 4). The inserter has means indicated generally at 29 at its forward end for gripping a liner 9 for forward movement of the liner with the inserter into the opened uppermost bag.

At 31 is generally indicated means for moving the inserter or ram longitudinally of the apparatus through a forward stroke (toward the left as viewed in FIG. 1) from its retracted position of FIG. 1 and then through a rearward return stroke back to its retracted position. At 33 is generally indicated means for feeding a liner 9 from the supply thereof to bring the liner into position for being gripped by the gripping means 29 for insertion of the liner in the opened uppermost bag. At 35 is generally indicated outfeed means located forward of the stack holding means 1 engageable with a lined bag 5 in the outfeed position for feeding the lined bag forward out of the apparatus. And, as will appear, the apparatus has means indicated generally at 37 for operating the gripping means 29 to grip a liner fed into position for being gripped and for releasing the grip after insertion of the liner for retraction of the inserter without retraction of the liner.

As noted above, the liners 9 are supplied from roll 17, being fed forward from the roll with each line of weakness 19 at the leading (forward) side of the bottom seal 15 of the next liner in the series by the feeding means 33. The latter includes means indicated generally at 39 for tearing or "snapping" off the leading liner 9 at the line of weakness 19 which defines its mouth end (and which trails the bottom seal 15 of that liner), the snapped-off liner being fed into position for having its bottom closure end gripped by the aforesaid gripping means 29 at the forward end of the inserter 27 as the latter moves forward.

Figure 6:
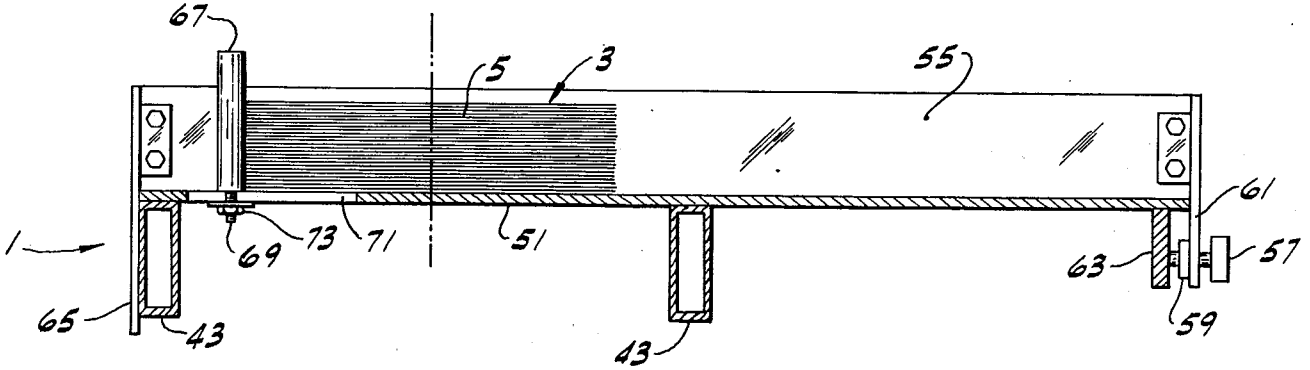
FIG. 6 is an enlarged vertical transverse section taken generally on line 6—6 of FIG. 1.

The apparatus comprises a frame 41 including a pair of lower side frame members 43 and a pair of upper side frame members 45 extending between legs 47 at the rearward end of the apparatus (its right end as viewed in FIG. 1) and legs 49 at the forward end of the apparatus (its left end as viewed in FIG. 1). The means 1 for holding the stack 3 of bags 5 comprises a shelf or table 51 mounted on the lower side frame members 43 adjacent the forward end of the apparatus, this table extending laterally to one side of the apparatus (its side as viewed in forward or downstream direction) to facilitate placement of a stack of bags thereon. The table has an upwardly extending fixed guide or stop 53 at its rearward end extending transversely of the apparatus for engagement by the rearward end of a stack 3 on the shelf (i.e., for engagement by the mouth ends of the bags 5 in the stack, and an upwardly extending adjustable guide 55 extending transversely of the apparatus and slidable forward and rearward on the table to a position spaced forward of the fixed guide or stop 53 a distance corresponding to the length of the bags 5 in the stack. The adjustable guide 55 is adapted to be secured in adjusted position by means of a lock screw such as indicated at 57 in FIG. 6 threaded in a nut 59 on a leg 61 extending down from one end of the guide on the outside of a side frame member 63 for the right side of the table, the guide having a leg 65 at its other end engageable with the left-hand lower side frame member 43. Means constituted by a pin or post 67 (see FIG. 6) extending up from the table 51 is provided for determining the position of the stack 3 transversely of the table (and hence transversely of the apparatus). This post, which is engageable by the left side of the stack as the stack is slid toward the left on the table (between the rearward and forward guides 53 and 55), is adjustable transversely of the table to accommodate bags of different widths. For this purpose, the post has a screw 69 extending from its lower end through a transverse slot 71 in the table, a nut 73 being threaded on the lower end of the screw below the table to lock the post in adjusted position. It will be understood that the post is positioned for locating the stack 3 of bags with the longitudinal central plane of the stack generally coincident with the longitudinal central plane of the apparatus.

Figure 7:
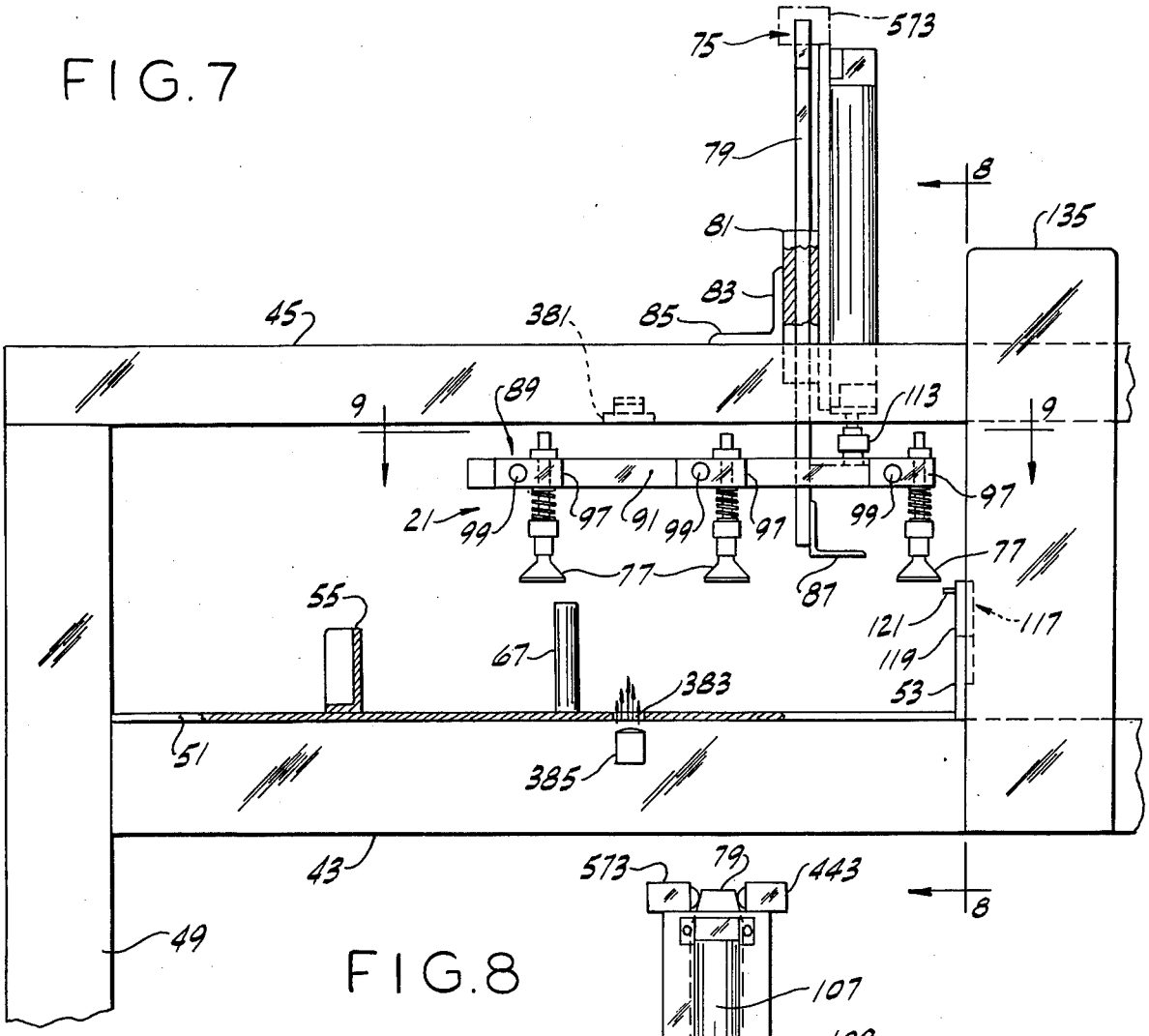
FIG. 7 is an enlarged fragment of FIG. 1 with parts broken away and shown in section.
Figure 8:
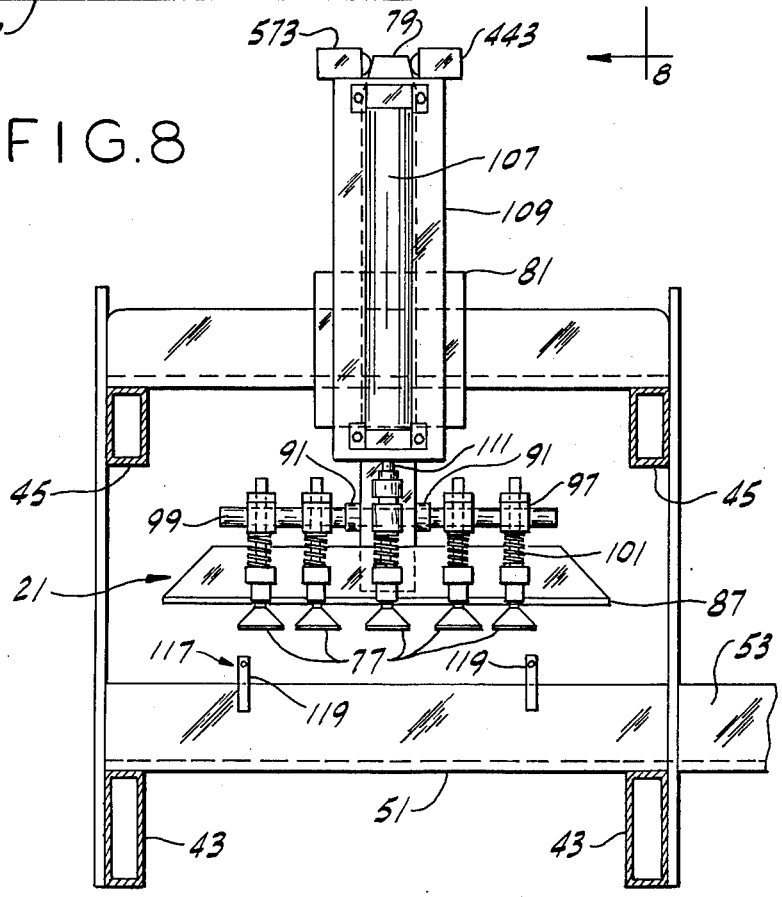
FIG. 8 is a vertical transverse section taken generally on line 8—8 of FIG. 7.

The means 21 for raising the upper wall 23 of the uppermost bag 5 of the stack 3 on the table 51 away from the lower wall 25 of the bag to open the bag for insertion of a liner therein comprises an elevator 75 carrying a set of suction cups 77 for vacuum gripping the upper wall 23 of the uppermost bag 5 of the stack 3 on the table 51. The elevator 75 is movable downwardly from a raised position wherein it is located above the stack of bags on the table to bring the suction cups 77 down into engagement with the upper face of the upper wall 23 of the uppermost bag of the stack and then movable upwardly to raise the upper wall as will appear. The elevator comprises a bar 79 vertically slidable in a guide 81 secured to the vertical leg 83 of an angle iron 85 spanning the upper side frame members 45 above the table 51 (see particularly FIGS. 7 and 8). The guide 81 and the bar 79 are located in a vertical transverse plane of the apparatus spaced somewhat forward of the vertical transverse plane of the rear of the table. At the lower end of the bar 79 is a foot 87 which acts as a stop engageable with the top of the stack 3 as the bar is lowered.

Figure 10:
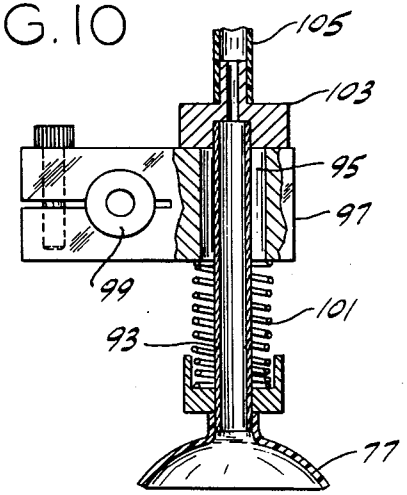
FIG. 10 is an enlarged vertical section taken generally on any one of lines 10—10 of FIG. 9.
Figure 9:
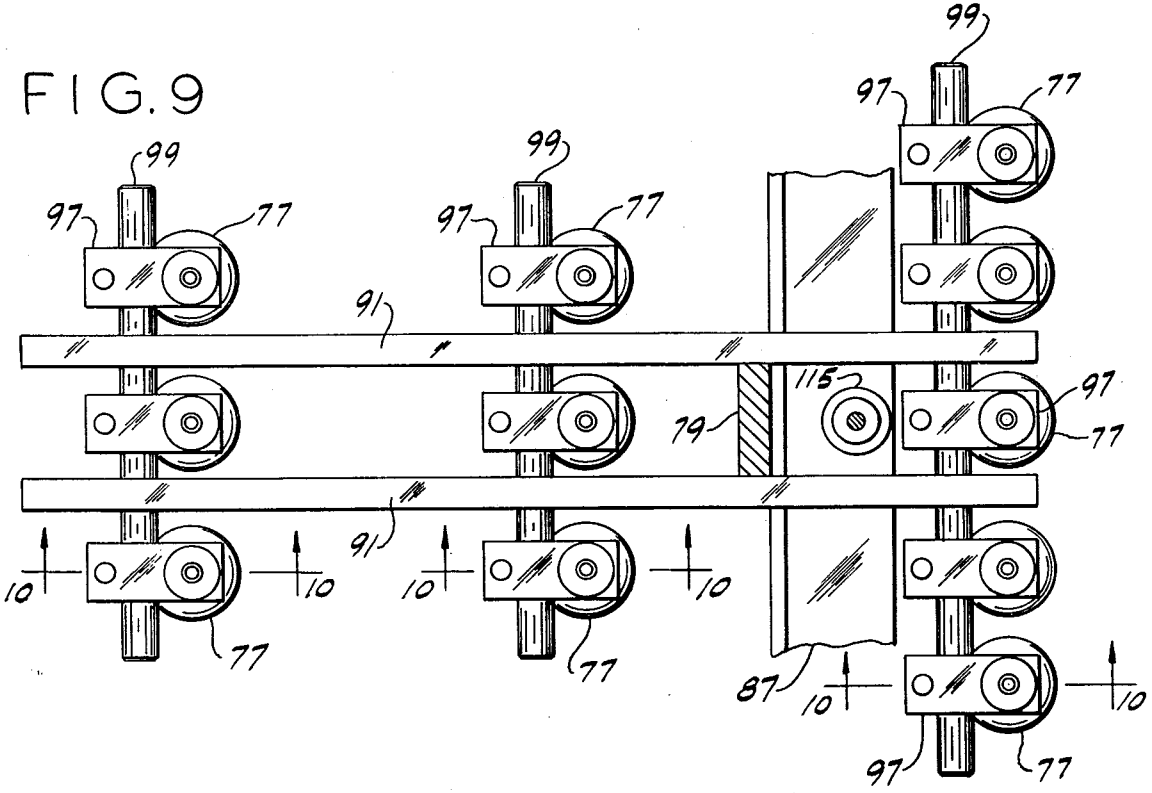
FIG. 9 is an enlarged horizontal section taken generally on line 9—9 of FIG. 7.

Extending forward and rearward from the bar 79 above the foot is a suction cup carrier generally designated 89. This comprises a pair of side bars 91 (see particularly FIG. 9) extending horizontally and longitudinally of the apparatus on opposite sides of the bar 79. As shown herein, there are three transverse rows of suction cups, the first row being rearward of the foot 87 and the second and third rows being forward of the foot. As to each row, the suction cups 77, which are conventional rubber suction cups, are mounted at the lower ends of tubular stems 93 (see particularly FIG. 10) which are freely vertically movable in holes 95 in arms 97 adjustably clamped on cross-shafts 99 mounted in the side bars 91. Springs 101 bias the suction cups down to a lowered position determined by engagement of heads 103 on the stems with the top of the arms 97. The cups, when in lowered position, are slightly below the level of the bottom of the foot. Thus, when the elevator 75 comes down, the cups engage the upper wall 23 of the uppermost bag 5 of the stack 3 first and then yield against the bias of springs 101 as the foot completes its downward movement into engagement with the top of the stack. This provides for spring-pressurized engagement of the suction cups with the upper wall of the uppermost bag. There may be five suction cups in the first row, and three each in the second and third rows. The second row (the middle row) may in some circumstances be omitted. Suitable flexible vacuum lines such as indicated at 105 are connected to the upper ends of the tubular stems for the suction cups, and these lines are connected to a suitable vacuum source under control of suitable valve means, as will appear, for drawing a vacuum in the suction cups whereby the cups vacuum-grip the upper wall of the uppermost bag of the stack. The elevator 75 is adapted to be raised and lowered by means of an air cylinder 107 mounted in vertical position on a mounting plate 109 secured to the guide 81. This air cylinder, which is a double-acting cylinder, has a piston rod 111 extending down from the piston 113 therein through the lower end head of the cylinder to a connection at 115 with the suction cup carrier 89.

Figure 11:
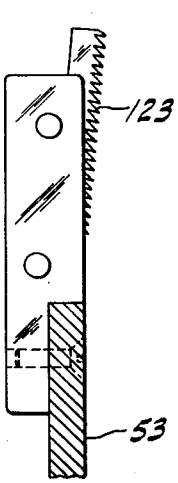
FIG. 11 is a view showing a modification of part of the apparatus for handling bags such as sewn open-mouth bags.
Figure 12:
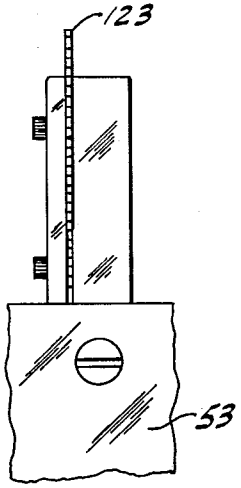
FIG. 12 is a side elevation of FIG. 11.

The arrangement is such that when the piston rod 111 of cylinder 107 is retracted, the foot 87 and the suction cups 77 are lifted to a raised position (FIGS. 1–4, 7 and 8) wherein the cups are above the top of a full stack 3 of bags 5 on the table 51, and when the piston rod is extended the suction cups are moved down into engagement with the upper wall 23 of the uppermost bag of the stack. The length of the stroke of the piston rod 111 and the position of the cylinder 107 are such that the suction cups may be lowered into engagement with successive bags of the stack as the stack is depleted. Thus, the suction cups 77, when in their raised retracted position, are spaced from table 51 a distance greater than the maximum height of the stack 3, and are movable downwardly through a distance greater than said height. When the last bag of the stack has been lined and fed out of the apparatus, another stack is slid into place on the table 51. Means indicated generally at 117 is provided for engagement by the lower wall 25 of the uppermost bag at its mouth at its upper wall 23 is raised by the suction cups 77 to hold the lower wall down at the bag mouth while the upper wall is raised so as to open the mouth of the bag for insertion of the liner. For pinch bottom open-mouth bags as to which the lower wall 25 projects beyond the upper wall 23 at the mouth of the bag, this means may comprise a pair of members 119 mounted on the fixed rear guide 53 having forwardly projecting pins 121 engageable by the projecting flap portion of the lower wall of the upper bag as the bag is raised (see FIG. 2) to hold down the lower wall of the bag at the mouth of the bag while the suction cups 77 continue on up to the upper limit of their stroke to open up the bag. For sewn open-mouth bags, in which the mouth edges of the bag walls are flush with one another, means 117 may comprise a series of toothed members such as indicated at 123 in FIGS. 11 and 12, the teeth of which are engageable by the mouth edge of the lower wall of the bag to hold down this edge for the opening up of the bag.

Figure 14:
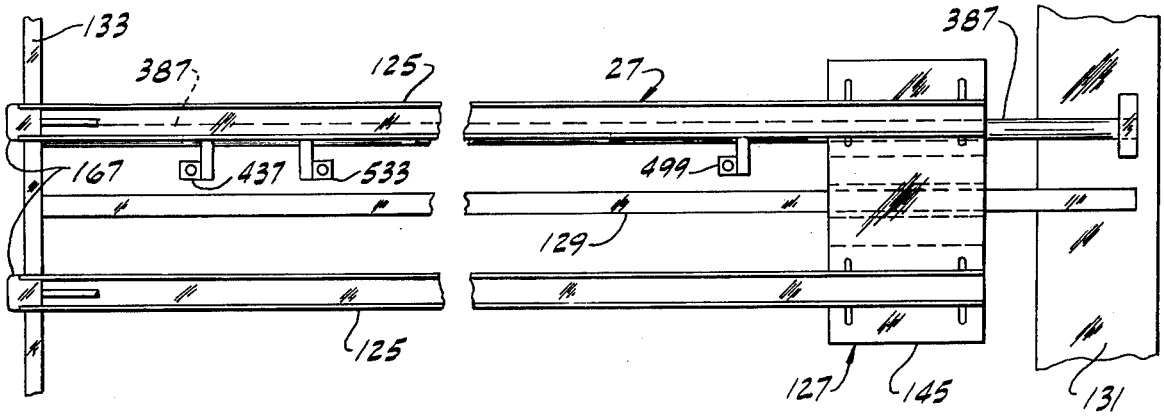
FIG. 14 is a plan view of FIG. 13.
Figure 15:
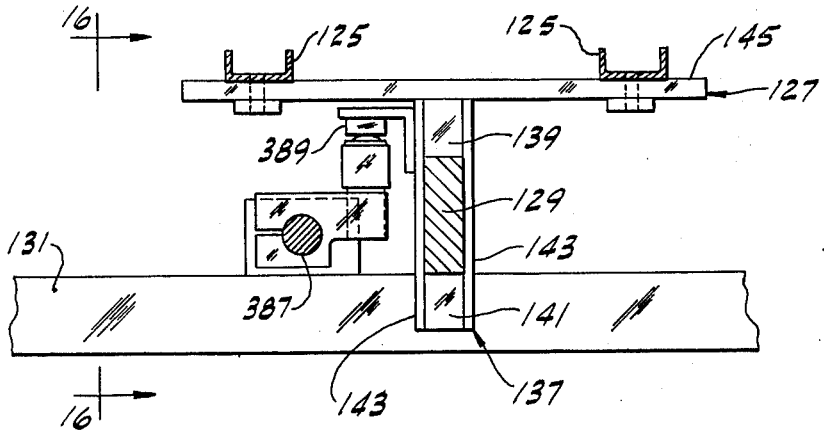
FIG. 15 is a vertical transverse section on line 15—15 of FIG. 13.

The liner inserter 27 is generally in the form of an elongate narrow two-tined fork comprising a pair of elongate tines each of which is an elongate bar 125 of channel shape in cross section (see FIGS. 13–15), these bars having their rearward ends mounted on a carriage indicated generally at 127 slidable longitudinally of the apparatus on a guide rail 129 of rectangular cross section extending in the central vertical longitudinal plane of the apparatus from the rear end of the apparatus to a point somewhat to the rear of the rear of the table 51. The guide rail 129 has its rearward end secured to a rear transverse frame member 131 extending between the rear legs 47 of the frame 41 and its forward end secured to a transverse frame member 133 extending between a pair of intermediate side frame members 135 of the frame 41. The carriage comprises a box guide 137 made up of upper and lower blocks 139 and 141 and side plates 143, and a table plate 145 mounted on top of the box guide, the latter and the table plate forming a T. The channel bars 125 are suitably secured on the table plate 145 and extend forward therefrom in adjustable side-by-side relation in a horizontal plate at such a level as to be adapted for entry into the opened uppermost bag 5 of the stack 3 on the table 51.

The carriage 127 is movable forward on the rail 129 from a retracted position, adjacent the rear end of the rail (see FIGS. 1 and 13) through a forward stroke to an advanced position adjacent the forward end of the rail to move the inserter bars 125 forward, and movable rearward back to its retracted position for retracting the inserter bars. The means 31 for so moving the carriage and the inserter bars comprises an elongate air cylinder 149 extending longitudinally of the apparatus below the rail 129, mounted at its rearward end on a transverse frame member 151 extending between the lower side frame members 43 adjacent the rearward end of the apparatus and at its forward end on a transverse frame member 153 extending between the lower side frame members 43 below and slightly to the rear of member 133. A piston 155 slidable in the cylinder 149 is interconnected with the carriage 127 via a cable 157 extending rearward from the piston through the rearward end head of the cylinder and thence around a pulley 159 at the rear end of the cylinder to a connection at 161 with the carriage at the bottom of the box guide 137, and a cable 163 extending forward from the piston through the forward end head of the cylinder and thence around a pulley 165 at the forward end of the cylinder to a connection at 161 with the carriage at the bottom of the box guide. The arrangement is such that on forward movement of the piston 155 to the forward end of the cylinder 149, the carriage is pulled back to its retracted position adjacent the rearward end of the rail thereby to retract the inserter bars 125 (see FIG. 13), and on rearward movement of the piston 155 to the rearward end of the cylinder 149, the carriage is pulled forward to a point adjacent the forward end of the rail 129 to move the inserter bars 125 through a forward stroke.

Figure 17:
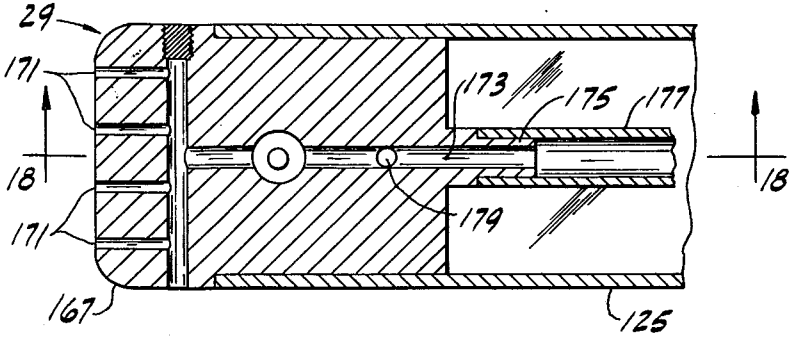
FIG. 17 is an enlarged section taken generally on line 17—17 of FIG. 13.
Figure 18:
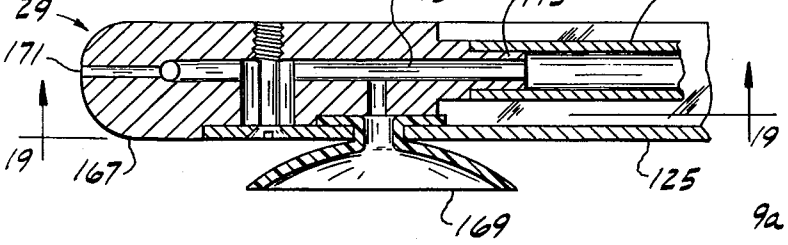
FIG. 18 is a vertical section on line 18—18 of FIG. 17.
Figure 19:
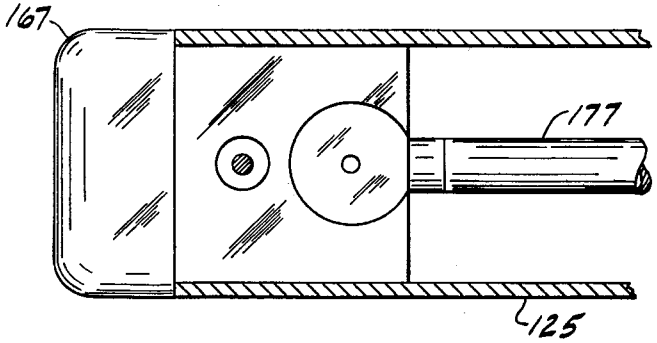
FIG. 19 is a section taken generally on line 19—19 of FIG. 18.
Figure 23:
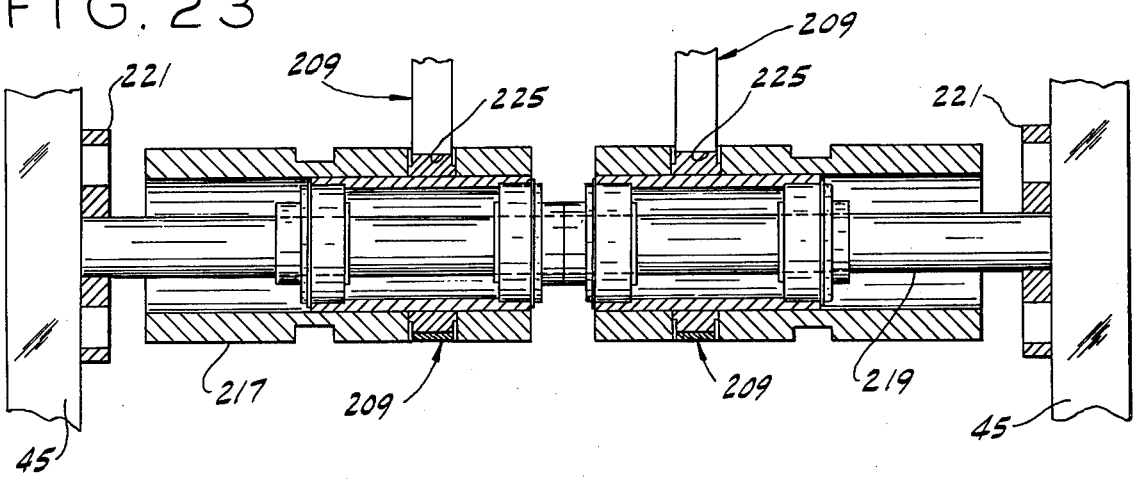
FIG. 23 is an enlarged section taken generally on line 23—23 of FIG. 21.
Figure 20:
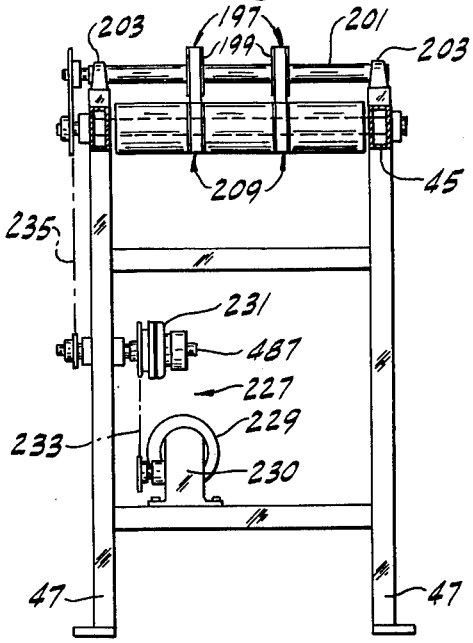
FIG. 20 is a right end elevation of FIG. 1.
Figure 21:
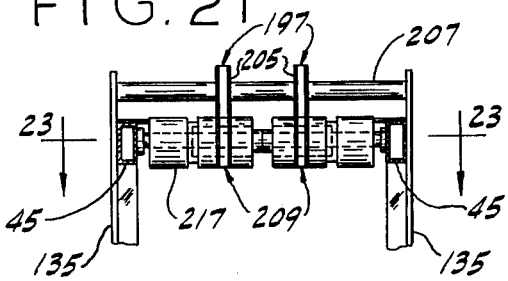
FIG. 21 is a vertical transverse section taken generally on line 21—21 of FIG. 1 with parts omitted.

The means 29 at the forward end of the liner inserter 27 for gripping a liner 9 comprises a pair of vacuum heads 167, one at the forward end of each of the two inserter bars 125, and a pair of suction cups 169, one on the bottom of each of the inserter bars adjacent its forward end (see FIGS. 17–19). Each vacuum head 167 has a plurality of vacuum ports 171 at its forward end in communication as indicated at 173 with a nipple 175 for connection of a vacuum line 177, which may extend along the inserter bar within the channel thereof. The suction cup 169 is also in communication with the nipple as indicated at 179.

Figure 13:
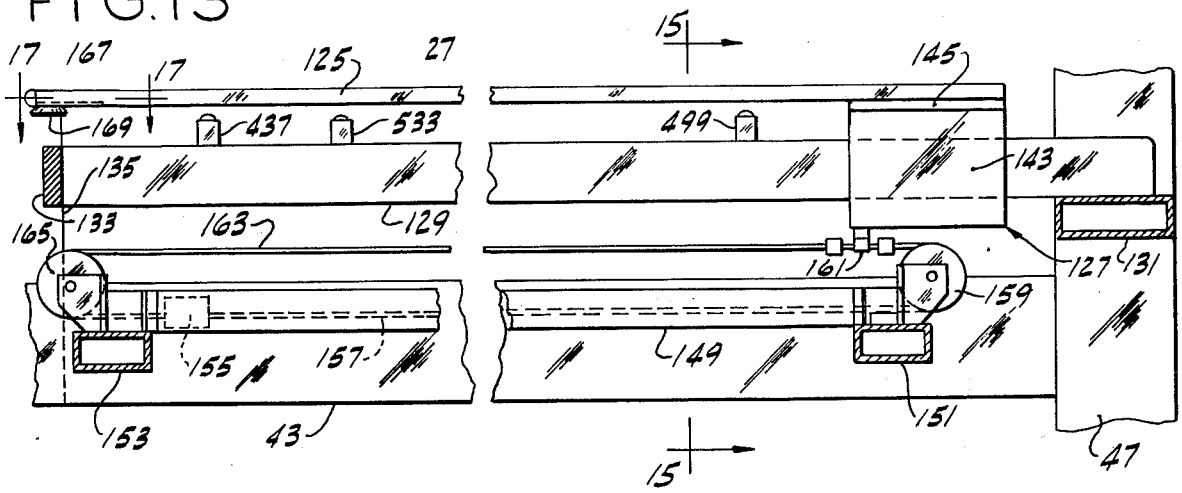
FIG. 13 is an enlarged fragment of FIG. 1 with parts broken away and shown in section.

When the carriage 127 of the liner inserter 27 is in its retracted position at the rear end of the apparatus (as shown in FIGS. 1 and 13), the inserter bars 125 extend forward therefrom to a point adjacent the transverse frame member 133 (to which the forward end of rail 129 is secured) and somewhat rearward of a brush 181 which extends between the intermediate side frame members 135. Adjacent their forward ends, the inserter bars 125 rest on another brush 183 mounted on the rail 129. As the inserter bars move forward, they slide first over the brush 183 and then over the brush 181. A liner guide 187 extends between the intermediate side frame members 135 slightly above the horizontal plane of the inserter bars 125 and slightly rearward of the brush 181.

The liner feed means 33 (see FIGS. 1 and 20–27) comprises an endless belt conveyor designated in its entirety by the reference numeral 189 for unwinding the series of interconnected liners 9 from the roll 17 and feeding the liners over an upper table 191 above the inserter 27. The roll 17 is mounted on a shaft 193 carried by brackets 195 at the rearward end of the apparatus. The upper table 191 comprises a plate mounted on the upper side members 45 of the frame extending from adjacent the rearward end of the apparatus to a point somewhat rearward of the intermediate side frame members 135. The endless belt conveyor 189 comprises a pair of upper narrow endless belts each designated 197 trained around a pair of pulleys 199 on an upper rear conveyor shaft 201 journalled in bearings 203 on the upper ends of the rear legs 47 of the frame 41 and a pair of pulleys 205 rotatable on an upper forward fixed conveyor shaft 207 which extends between the intermediate side frame members adjacent their upper ends. The belts are located side-by-side with a substantial space therebetween. Each has a lower horizontal forward liner feed reach 197*a* and an upper lower horizontal return reach 197*b*.

The endless belt conveyor 189 further comprises a pair of lower narrow endless belts 209, in the planes of the upper belts 197 trained at the rear around a roll 211 on a shaft 213 journalled in bearings 215 on the upper side frame members 45 adjacent their rearward ends and at the forward end of the upper table 191 around a roll 217 on a shaft 219 journalled in bearings 221 on the inside of the upper side frame members 45 slightly to the rear of the vertical transverse plane of the pulley shaft 207. The belts 209 are guided and held in spaced relation coplanar with belts 197 by being received in annular grooves 223 in the rear roll 211 and in annular grooves 225 in the forward roll 217. The upper reaches 209*a* of the lower belts 209 travel forward over the liner table 191 in engagement with the forward-travelling lower reaches 197*a* of the upper belts 197. The lower reaches 209*b* of the lower belts travel back under the liner table 191. The belts 197 and 209 may be timing belts, i.e., belts having transverse teeth, and the pulleys 199 and 205 and grooves 223 and 225 in the rolls 211 and 217 may be correspondingly toothed for positive nonslip drive of the belts.

The belts 197 and 209 are adapted intermittently to be driven by drive means 227 therefor comprising an electric motor 229 connected to drive the input of a speed reducer 230. The output of the speed reducer is connected to drive the input of an air-operated clutch 231 via a chain and sprocket drive 233. A chain and sprocket drive 235 connects the output of the clutch to the shaft 201 for the rear pulleys 199 for the upper belts 197 and also to the roll 211 for the lower belts 209. In operation, the motor 229 is continuously energized, and the belts 197 and 209 are intermittently driven by intermittently engaging the clutch 231, as will appear.

Figure 22:
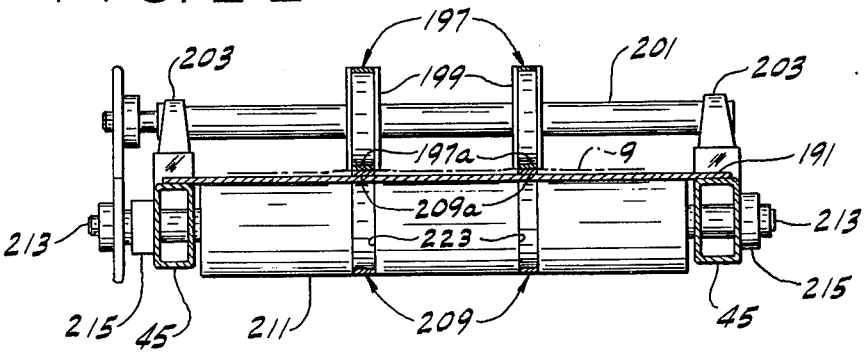
FIG. 22 is a vertical transverse section taken generally on line 22—22 of FIG. 1.
Figure 25:
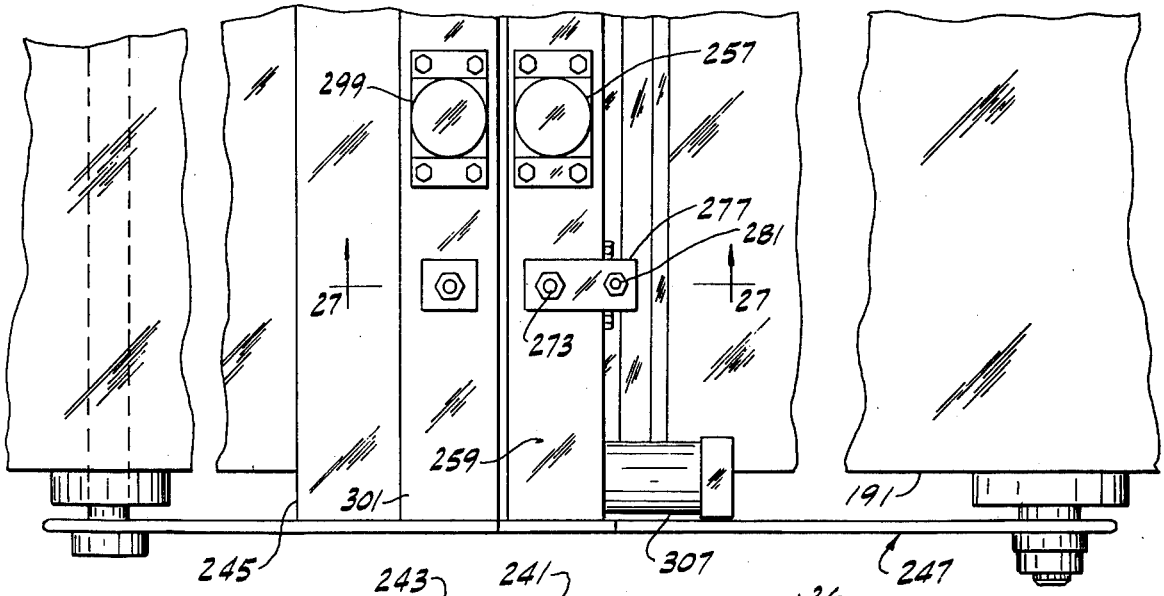
FIG. 25 is a partial plan of FIG. 24.
Figure 24:
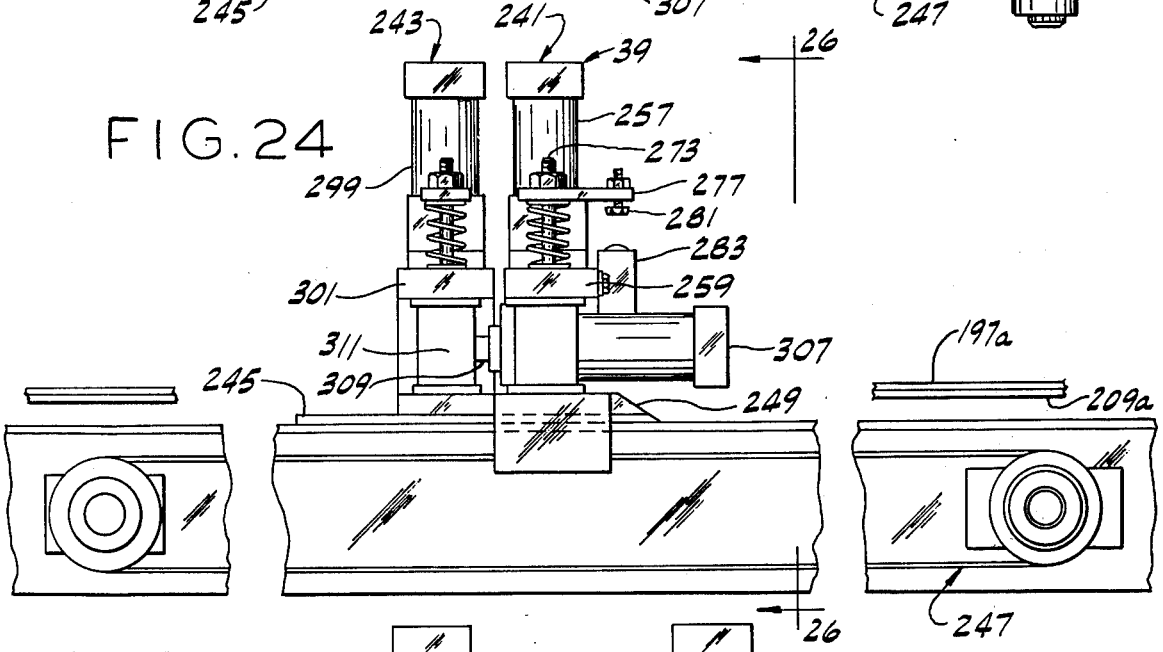
FIG. 24 is an enlarged fragment of FIG. 1.
Figure 26:
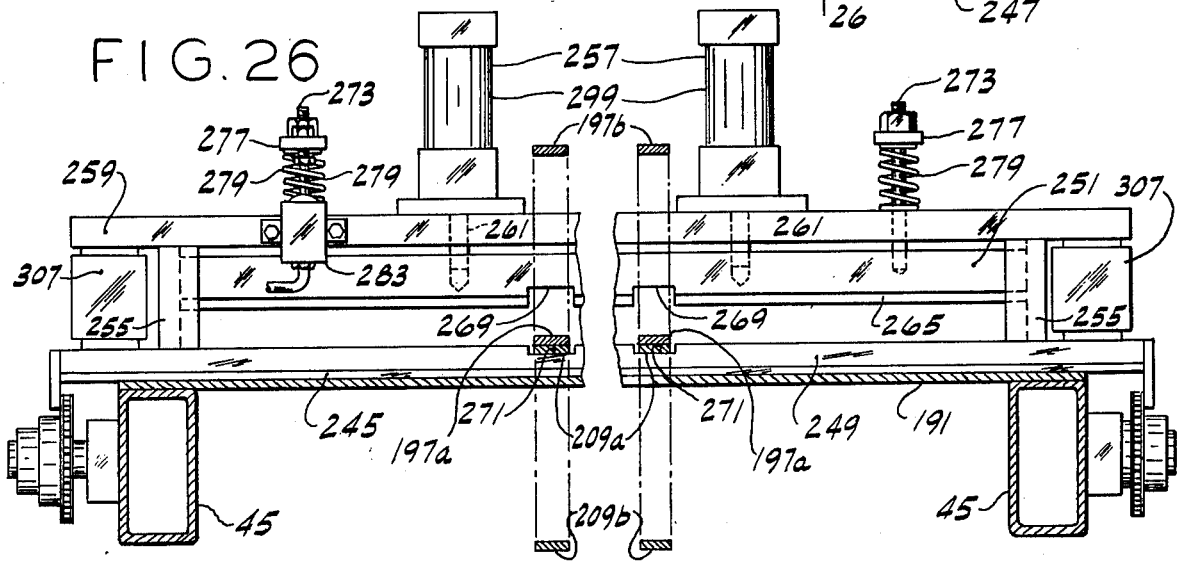
FIG. 26 is a vertical transverse section taken on line 26—26 of FIG. 24.

The lower reaches 197*a* of the upper liner feed belts 197 and the upper reaches 209*a* of the lower lever feed belts 209 are adapted to engage the continuous series of liners 9 unwound from the roll 17 as shown in FIG. 22 and to feed the series forward over the table 191, around the lower forward roll 217 and thence downward in a vertical plane rearward of the liner guide 187 and between the forward ends of the inserter bars 125 and the forward brush 181, to a point where the downwardly hanging leading end portion of the continuous series of liners 9 intercepts a beam of light from a lamp 237 to a photocell 239 (see FIG. 2). This stops the feed of the series of liners 9 with the leading end of the series in a position such as shown in FIG. 2 below the level of the inserter bars 125, and initiates a sequence of operations as will appear. The leading liner of the series is specially designated 9*a*, and the next or second liner of the series is specially designated 9*b*.

Referring to FIGS. 24–27, the means 39 for tearing or snapping off the leading liner 9*a* is shown to comprise a first clamping means 241 operable at a clamping station along the path of the upper table 191 for clamping the second liner 9*b* to enable the first liner 9*a* to be pulled forward and torn or snapped off from the second liner 9*b*. This first clamping means is located slightly rearward of the location of the line of weakness 19 where the first and second liners 9*a* and 9*b* are interconnected when the liner feed stops. Means 39 further comprises a second clamping means 243 for clamping the first liner 9*a* slightly forward of the location of the line of weakness 19 where the first and second liners 9*a* and 9*b* are interconnected when the liner feed stops, this second clamping means being movable forward away from a retracted position in front of and closely adjacent the first clamping means 241 to pull the trailing end portion of the first liner 9*a* forward away from the leading end portion of the second liner 9*b*, thereby to tear or snap off the first liner 9*a* from the second liner 9*b* at the line of weakness 15 therebetween.

Figure 27:
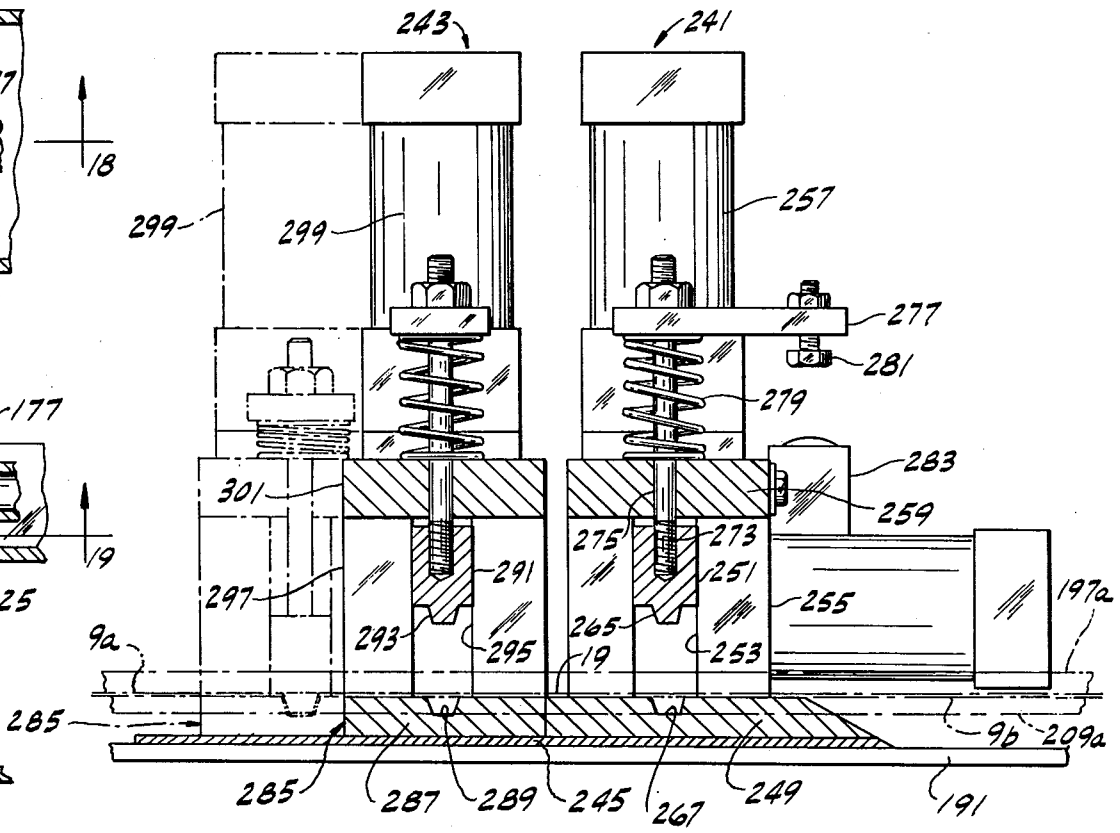
FIG. 27 is a vertical longitudinal section taken generally on line 27—27 of FIG. 25.

Both the first and second clamping means 241 and 243 are carried by a supporting plate 245 adjustably slidable on the upper table 191 longitudinally of the upper table properly to position the clamping means for operation on liners 9 of different lengths. Chain and sprocket mechanism such as indicated at 247 is provided for adjusting the plate 245 longitudinally of the table 191, suitable locking means (not shown) being provided for locking the plate in adjusted position. The first clamping means 241 comprises an elongate lower jaw 249 secured on the plate 245 extending transversely of the apparatus and an elongate upper jaw 251 above the lower jaw 249 mounted for movement from a raised retracted or open position (in which it is shown in FIG. 27) downwardly toward the lower jaw for clamping the second liner 9b between the jaws. The upper jaw 251 is guided for vertical movement by having its ends vertically slidable in guideways 253 in guides 255 extending up from the fixed lower jaw 249 adjacent its ends. It is movable up and down by means of a pair of air cylinders each designated 257 mounted in vertical position on a bridge 259 spanning the guides 255, these air cylinders having piston rods 261 extending from pistons 263 therein through openings in the bridge connected to the upper jaw. The arrangement is such that on retraction of the piston rods 261 the upper jaw 251 is raised, and on extension of the piston rods 261 the upper jaw 251 is lowered to clamp the second liner 9*b*. The upper jaw 251 has a rib 265 on the bottom receivable in a groove 267 in the lower jaw 249 for tightly clamping the second liner 9*b*, and the upper and lower jaws are notched as indicated at 269 and 271, respectively, in FIG. 26 for passage of the lower reaches 197*a* of the upper belts 197 and the upper reaches 209*a* of the lower belts 209.

Rods 273 extend up from the upper jaw 251 through openings 275 in the bridge 259 and have heads 277 at their upper ends above the bridge. Coil compression springs 279 surrounding the rods react from the bridge against the heads to bias the upper jaw upwardly. One of the heads 277 extends rearwardly beyond the vertical plane of the rearward edge of the bridge and has a screw 281 adjustably threaded in its rear end engageable with a valve 283 mounted on the rear edge of the bridge to actuate this valve when the jaw 251 is closed (i.e., moved downward) to clamp the liner 9*b*.

The second clamping means 243 comprises a lower and upper jaw assembly 285 extending transversely of the apparatus on the plate 245 in front of the first clamping means 241 and slidable longitudinally of the apparatus on the plate 245 from the retracted position closely adjacent the first clamping means 241 in which it is shown in solid lines in FIG. 27 through a forward stroke to the advanced position in which it is shown in phantom in FIG. 27 for snapping off the first liner 9*a* from the second liner 9*a*, and back through a return stroke to its retracted position. The lower jaw 287 of the second clamping means 243 is an elongate jaw having a groove 289, and the upper jaw 291 of the second clamping means is an elongate jaw having a rib 293. The upper jaw is guided for vertical movement by having its ends vertically slidably in guideways 295 in guides 297 extending up from the lower jaw 287 adjacent its ends. The upper jaw 291 is movable up and down by means of a pair of air cylinders 299 mounted in vertical position on a bridge 301 spanning the guides 297 in front of the first bridge 259. These cylinders are double-acting cylinders having piston rods 303 extending from pistons 305 therein through openings in the bridge 301 connected to the upper jaw. The upper jaw 291 may be spring-biased to return upward to its open position similarly to the upper jaw 251.

The second clamping means 243 is movable forward away from its rearward retracted position and rearward back to its retracted position by means of a pair of double-acting air cylinders each designated 307 mounted in horizontal position extending longitudinally of the apparatus on the lower jaw 249 of the first clamping means 241 at the ends thereof. Piston rods 309 extend forward from the cylinders 297 to connections at 311 with the second clamping means 243, the arrangement being such that when the piston rods 309 are retracted, the second clamping means 243 is retracted and, when the piston rods 309 are extended, the second clamping means is moved through a forward stroke away from the first clamping means 241 to snap off the liner 9*a*.

Figure 28:
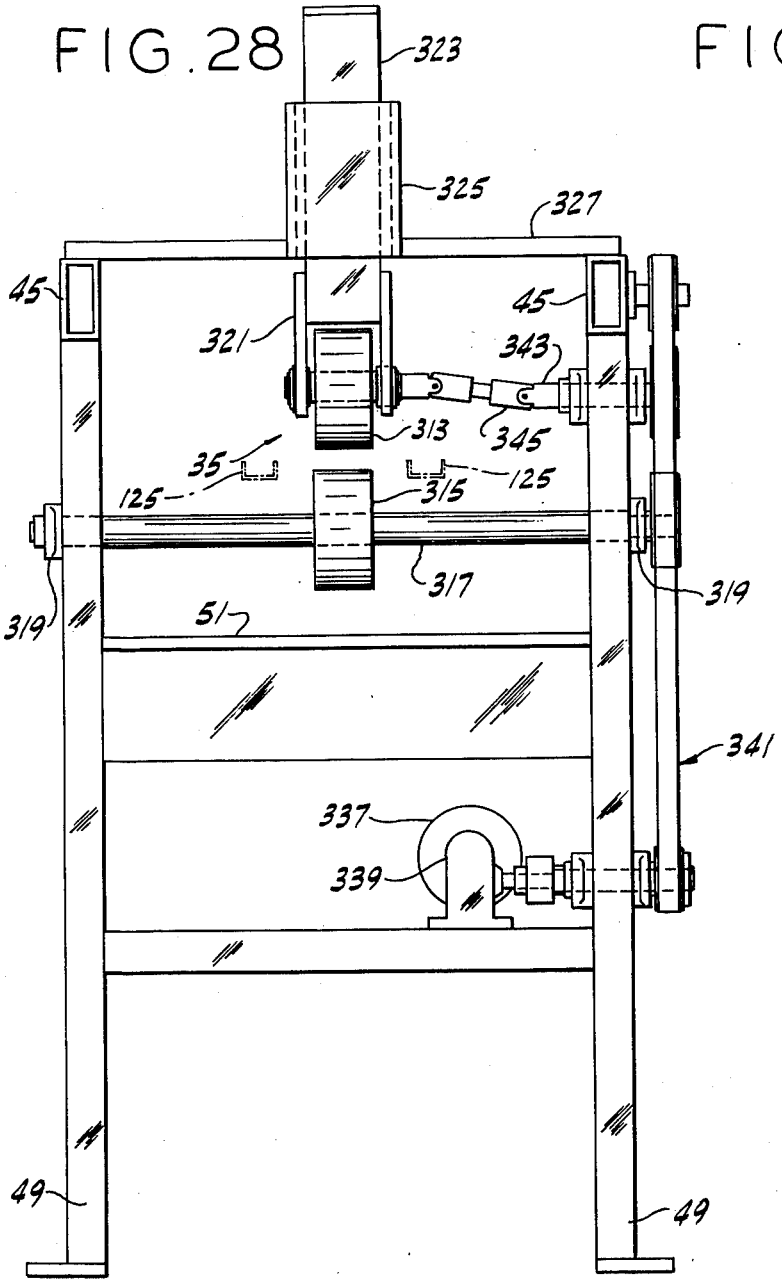
FIG. 28 is an enlarged left end elevation of FIG. 1.
Figure 29:
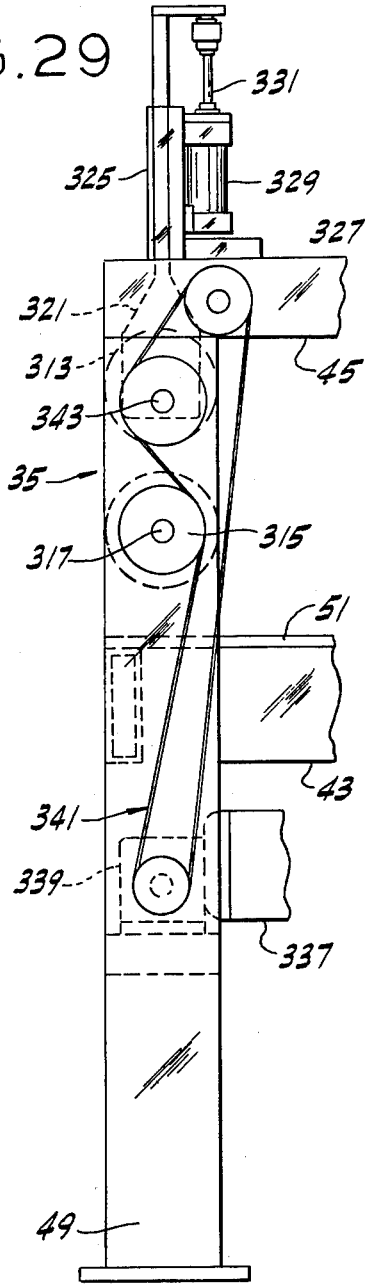
FIG. 29 is a right side elevation of FIG. 28.

Referring to FIGS. 28 and 29, the outfeed means 35 is shown to comprise upper and lower feed rolls 313 and 315, of which the lower roll 315 is mounted on a shaft 317 journalled at its ends in bearings 319 on the legs 49 at the forward end of the frame 41 and the upper roll 313 is mounted for movement from a raised retracted position spaced from the lower roll and a lowered position for gripping a lined bag between the rolls and feeding it forward out of the apparatus. The upper roll 313 is mounted in a yoke 321 having an upper slide 323 vertically slidable in a guide 325 on a bridge 327 spanning the upper side members 45 of the frame 41 at the forward end of the apparatus. The slide is movable up and down by a double-acting air cylinder 329 mounted in vertical position on the bridge having a piston rod 331 extending up from a piston 333 therein to a connection at 335 with the slide. The arrangement is such that when the piston rod 331 is extended (raised) the roll 313 is raised and when the piston rod is retracted (lowered), the roll is lowered. Both rolls 313 and 315 are continuously driven in the direction for outfeed of lined bags from the apparatus via a motor 337, a speed reducer 339 and a chain and sprocket drive 341, the latter driving the shaft 317 for the lower roll, and an upper shaft 343 and universal-jointed drive 345 for the upper roll.

Figure 30A:
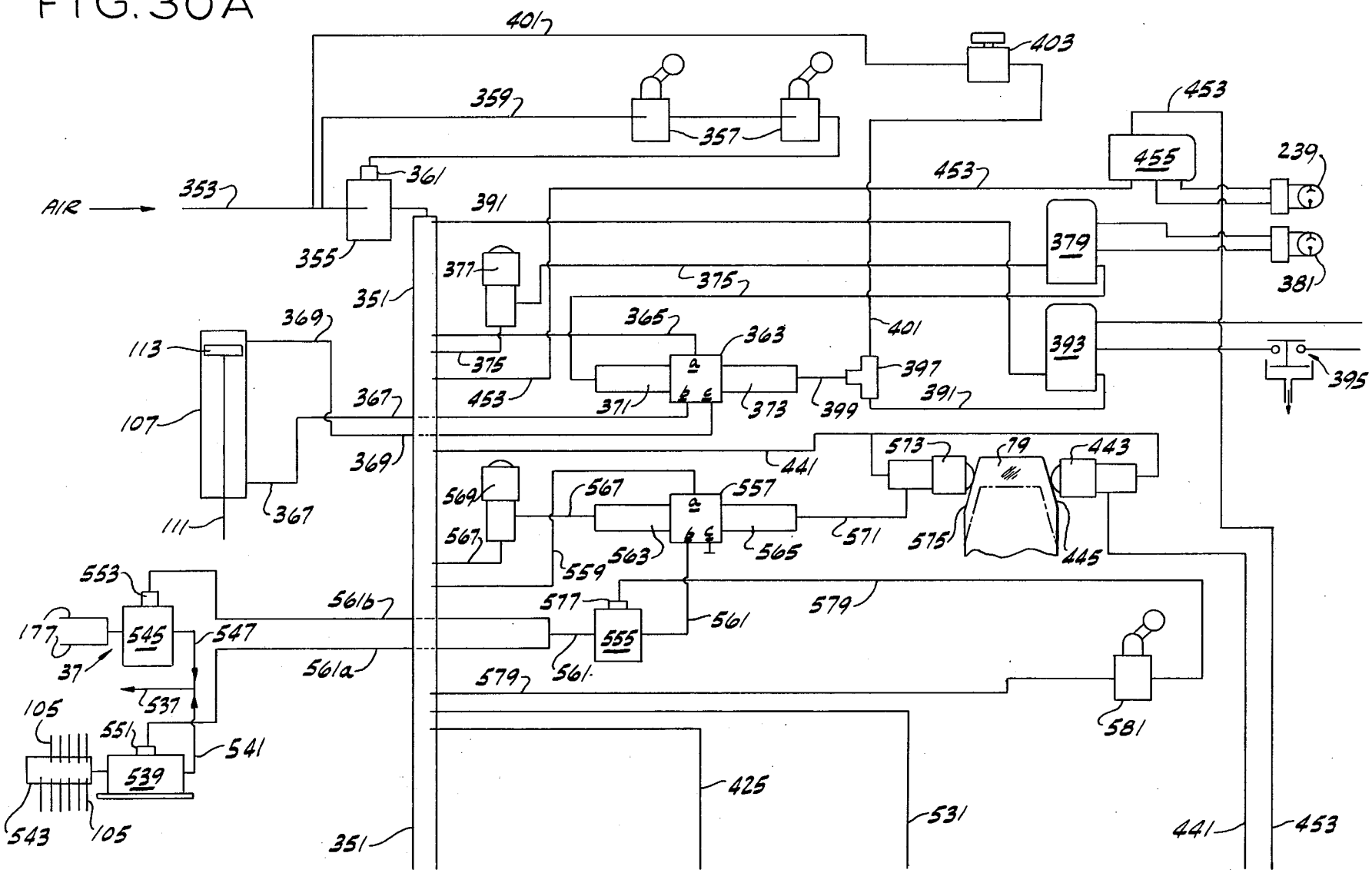
FIGS. 30A and 30B together constitute a diagram of the pneumatic circuitry of the apparatus.

Referring now to FIGS. 30A and B, showing the pneumatic control circuitry of the apparatus, there is indicated at 351 a manifold which is maintained supplied with compressed air from a suitable source as indicated at 353 under control of a three-way normally closed main valve 355. This valve is in turn under control of two manually operated pilot valves each designated 357, each of which is a three-way normally closed valve, connected in series in a line 359 extending from the supply line 353 to air-operated pilot 361 of valve 355. These pilot valves are operable to control valve 355 either to deliver air from the supply to the manifold, or to exhaust air from the manifold in an emergency or for servicing the apparatus.

The manifold supplies compressed air for operating the bag opening cylinder 107 under control of a four-way valve 363. This has a port *a* supplied with compressed air from the manifold 351 via a line 365, a port *b* connected via a line 367 to the lower end of cylinder 107 and a port *c* connected via a line 369 to the upper end of cylinder 107. It also has an air-operated pilot 371 adapted on being actuated by air to set it for delivering air via line 369 to the upper end of cylinder 107 and to vent air via line 367 from the lower end of the cylinder for driving piston rod 111 down, and an air-operated pilot 373 adapted on being actuated by air to set it for delivering air via line 367 to the lower end of the cylinder and to vent air via line 369 from the upper end of the cylinder for driving the piston rod 111 up.

Figure 16:
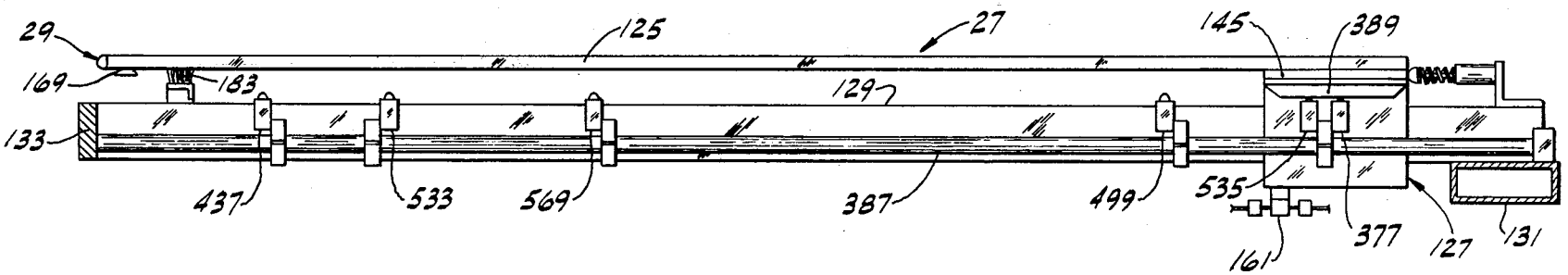
FIG. 16 is a view on line 16—16 of FIG. 15 showing certain valves.

The pilot 371 is adapted to be supplied with air from the manifold 351 via a line 375 including a three-way normally closed pilot valve 377 and a three-way normally closed pilot valve 379. The pilot valve 379 is a solenoid valve with is energized to open for operation of the apparatus when a stack 3 of bags 5 is placed on the table 51, and which is deenergized to deactivate the apparatus when the last bag of the stack 3 has been lined and fed out of the apparatus. For this purpose, valve 379 is controlled by a photocell 381 positioned to receive a beam of light beamed up through an opening 383 in the table 51 from a lamp 385 mounted underneath the table, the arrangement being such that when the beam is blocked by a stack of bags (down to the last bag) on the table 51, the photocell acts to effect energization of valve 379, but when the last bag is removed, the beam impinges on the photocell and the latter then effects deenergization of valve 379 to close it and deactivate the apparatus. The pilot valve 377 is a three-way normally closed button-operated valve. It is one of a series of valves to be described adjustably mounted on a rod 387 (see FIG. 16) which extends alongside the rail 129 for the inserter carriage 127. Valve 377, which is located adjacent the rear end of the rod 387 (adjacent the rear end of the rail 129) is operable by a cam 389 on the bottom of the table plate 145 of the inserter carriage 127. The arrangement is such that, as long as there is at least one bag on table 51 blocking the beam of light from the lamp 385, valve 379 is open and when the inserter carriage 127 is retracted cam 389 actuates valve 377 to supply air via line 375 to pilot 371 of valve 363, which sets the latter to deliver air via line 369 to the upper end of cylinder 107 and to vent the lower end of the cylinder via line 367, thereby extending (lowering) the piston rod 111 of cylinder 107 and lowering the suction cups 77.

The pilot 373 of valve 363 is adapted to be supplied with air from the manifold 351 via a line 391 which includes a three-way normally closed solenoid valve 393. This valve 393 is under control of a vacuum-operated switch 395 the vacuum operator of which is interconnected with the suction cups 77 to effect closure of switch 395 when vacuum is drawn in the cups 77, thereby to energize the solenoid of valve 393 to open valve 393. Line 391 from valve 393 is connected to a shuttle valve 397 from which a line 399 leads to the pilot 373. When valve 393 opens, it supplies air via lines 391 and 399 to pilot 373, which sets valve 363 to deliver air via line 367 to the lower end of cylinder 107 and to vent the upper end of cylinder 107 via line 369, thereby retracting (raising) the piston rod 111 of cylinder 107 to raise the suction cups 77.

Pilot 373 is also adapted to be supplied with air from the supply line 353 via a line 401 including a three-way normally closed manual pushbutton valve 403 and connected to the shuttle valve 397. This enables the suction cups 77 to be raised by manual operation without going through a cycle.

The manifold 351 also supplies air for operating the inserter cylinder 149 under control of a set of valves including a normally closed air-operated three-way valve 405 connected in a line 407 between the manifold and the forward end of cylinder 149 and a similar valve 409 connected in a line 411 between the manifold and the rearward end of cylinder 149. Valve 405 is normally closed against flow of air therethrough from the manifold and normally set to vent the forward end of the cylinder via a speed control valve 413. Valve 409 is normally closed against flow of air therethrough from the manifold and normally set to vent the rearward end of the cylinder via a speed control valve 415. Valve 405 has a pilot 417 adapted to be actuated to open the valve 405 for flow of air to the forward end of cylinder 149 by air from a pilot line 419 including a pilot valve 421. Line 419 extends from port *b* of a four-way control valve 423. The latter has a port *a* adapted to be supplied with air from manifold 351 via a line 425, and a port *c* connected by a line 427 to pilot 429 of valve 409. On flow of air via line 427 to pilot 429, valve 409 is opened for flow of air to the rearward end of cylinder 149. Valve 423 has air-operated pilots 431 and 433. Pilot 431, when supplied with air, sets valve 423 to deliver air to line 427 via its port *c* and vent line 419 via port *b*. Pilot 433, when supplied with air, sets valve 423 to deliver air to line 419 via its port *b* and vent line 427 via port *c*. A line 435 including a three-way normally closed button-operated valve 437 is connected between the manifold 351 and the pilot 431. This valve 437 is mounted on the rod 387 adjacent its forward end for actuation by the cam 389 as the inserter 27 reaches the forward end of its stroke. Valve 421 has an air-operated pilot 439 adapted, when supplied with air, to open it for delivery of air to pilot 417 of valve 405. A line 441 including a normally closed push-button pilot valve 443 is connected between the manifold 351 and the pilot 439. Valve 443 is mounted at the upper end of the plate 109 in position for actuation by a beveled cam edge 445 at one side of the upper end of bar 79 as the latter reaches the upper end of its stroke. When valve 443 is so actuated (on raising the suction cups 77) it supplies air to pilot 439 to open valve 421 for delivery of air to pilot 417 of valve 405.

A line 447 connected between line 441 and pilot 443 of valve 423 includes a three-way normally closed pilot valve 449. This valve has an air-operated pilot 451 adapted when supplied with air to open valve 449 to supply air to pilot 433. A line 453 including a normally closed three-way solenoid valve 455 is connected between the manifold 351 and the pilot 451. Valve 455 is controlled by the photocell 329, the arrangement being such that when the beam of light from lamp 237 is interrupted by the leading end of the liner 9a reaching the position shown in FIG. 2, valve 455 is energized to open to supply air via line 453 to pilot 451. This actuates valve 449 to deliver air to pilot 433 to actuate valve 423 to actuate valve 405 to drive the piston of cylinder 149 rearward, thereby driving the inserter forward.

The manifold 351 also supplies air for operating the cylinders 257, 299 and 307 of the liner snap-off means 39, under control of a valve 457 for the vertical clamp cylinders 257 and 299 and a valve 459 for the horizontal cylinders 307. Valve 457 is a four-way valve having a port *a* to which is connected an air supply line 461 from the manifold, a port *b* connected by line 463 to branch lines 465 to the upper ends of cylinders 257 and 299 and a port *c* connected by line 466 and branch lines 468 to the lower ends of cylinders 257 and 259.

Valve 457 has an air-operated pilot 467 adapted on being actuated by air to set it for supplying air via port *b* and line 463 to the upper ends of cylinders 257 and 259, and to vent the lower ends of these cylinders via line 466 and port *c*. Normally, valve 457 is set to supply air via port c and line 466 to the lower ends of cylinders 257 and 259 and to vent the upper ends of these cylinders via line 463 and port *b*. The delivery of air to pilot 467 is under control of a pilot valve 469 which is a normally open three-way valve connected in a line 471 from port *c* of a four-way control valve 473. Valve 469 has an air-operated pilot 475, interconnected with line 471 via a line 477 including a time-delay unit 479. The arrangement is such that on delivery of air via line 471, pilot 475 is operated to close the valve 469, thereby venting the plot 467 of valve 457 which sets valve 457 to supply air to the upper ends of cylinders 257 and 299 and vent their lower ends to lower the upper clamp jaws 251 and 291 of the liner clamping means 241 and 243. The pilot 475 remains on for an interval determined by the time-delay unit 479, and is then vented to allow valve 469 to open to deactuate valve 457. Upon deactuation of valve 457, it supplies air to the lower ends of cylinders 257 and 299 and vents their upper ends to raise the jaws 251 and 291.

Valve 473 has an inlet port *a* to which is connected line 481 from the manifold 351 and a port *b*, the latter being interconnected by a line 483 including a three-way toggle valve 485 (a manually operable valve) with the pilot 487 of the air-operated clutch 231 via a quick dump valve 489. Valve 485 is maintained open for operation of the apparatus, being shut to stop the apparatus in an emergency. Valve 473 has an air-operated pilot 491 adapted on being actuated by air to set the valve to deliver air via its port *c* through line 471 to valve 469 to effect raising of the jaws 251 and 291 after a time delay, and a pilot 493 adapted on being actuated by air to set the valve to deliver air via its port *b* through line 483 to engage the clutch 231 and start the liner feed. A line 495 interconnects line 453 and pilot 491 for delivering air to the latter when valve 455 opens, whereby valve 473 is set by the opening of valve 455 to effect raising of the jaws 251 and 291 after the time delay imparted by the time-delay unit 479. This time delay is sufficient to permit liner snap-off, as will appear. Pilot 493 is adapted to be supplied with air from manifold 351 via a line 497 including a three-way normally closed pushbutton valve 499 and a shuttle valve 501. Valve 499 is one of the series of valves on the rod 387 (see FIG. 16) and is located for actuation by the cam 389 on the inserter carriage 127 when the latter has moved forward some distance from its retracted position. When valve 499 is actuated, it supplies air to pilot 493 of valve 473, thereby setting the latter to deliver air via line 483 to the clutch pilot 487 to engage the clutch 231 to start the liner feed.

Pilot 493 is also adapted to be supplied with air from manifold 351 via a line 503 including a manually operable normally closed three-way valve 505, which may be opened manually to start the liner feed if desired.

Valve 459 is a four-way valve having a port *a* to which is connected an air supply line 507 from the manifold 351, a port *b* connected by a line 509 and branch lines 511 to the rearward ends of the horizontal snap-off cylinders 307, and a port *c* connected by a line 513 and branch lines 515 to the forward ends of the horizontal snap-off cylinders. Valve 459 has an air-operated pilot 517 adapted on being actuated by air to set it for supplying air via port *b* and lines 509 and 511 to the rearward ends of cylinders 307 and for venting the forward ends of these cylinders via lines 515 and 513 to drive piston rods 309 forward. Normally, valve 459 is set to supply air via port *c* to the forward ends of cylinders 307 and to vent their rearward ends, so that piston rods 309 are retracted. The delivery of air to pilot 517 is under control of the pilot valve 283 connected in a line 519 between the manifold 351 and pilot 517, the arrangement being such that when cylinders 257 move the clamp jaw 251 down to clamp the liner 9*b*, valve 283 is actuated to supply air to pilot 517 to actuate valve 459 to deliver air to the rearward ends of cylinders 307 and to vent air from their forward ends, thereby to drive the stated second clamping means 243 forward.

The cylinder 329 for operating the upper out-feed roll 313 is controlled by a four-way valve 521 having a port *a* to which is connected an air supply line 523 from the manifold, a port *b* connected by a line 525 to the lower end of the cylinder and a port *c* connected by a line 527 to the upper end of the cylinder. Valve 521 has an air-operated pilot 529 adapted on being actuated by air to set it for supplying air via port *c* and line 527 to the upper end of cylinder 329, and for venting the lower end of this cylinder via line 525 and port *b*. Normally, valve 521 is set to supply air via port *b* and line 525 to the lower end of cylinder 329 and to vent the upper end of the cylinder via line 527 and port *c*, whereby the piston rod 331 is normally extended (raised) and roll 313 is up. Pilot 529 is adapted to be supplied with air from manifold 351 via a line 531 including a normally closed two-way pusbutton valve 533. The latter is one of the series on the rod 387, being located on the rod somewhat rearward of valve 437, and is adapted for actuation by the cam 389 on the inserter carriage 127 as the inserter moves forward and approaches the forward end of its forward stroke. When valve 533 is so actuated, it supplies air to pilot 529 to set valve 521 to supply air to the upper end of cylinder 329 and to vent its lower end to retract (lower) its piston rod 333 and pull down the roll 313. A normally closed two-way pushbutton dump valve 535 is connected to line 531 between valve 533 and the pilot 529. This valve 535 is also one of the series of valves on the rod 387, being located slightly forward of valve 377 and being operable by the cam 389 on the inserter carriage 127 as the latter returns to its rearward retracted position to vent the pilot 529 so as to reset valve 521 to supply air to the lower end and vent air from the upper end of cylinder 329 to extend (raise) the piston rod 333 and thereby raise the roll 313.

Vacuum for the bag-opening suction cups 77 is drawn in these cups from a suitable source of vacuum such as indicated at 537 in FIG. 30A under control of a normally closed three-way valve 539. The latter is connected in a line 541 between a vacuum manifold 543 and the vacuum source 537, individual vacuum lines 105 extending from the manifold 543 to the cups 77. Vacuum for the gripper 29 of the inserter 127 is drawn from source 537 under control of a normally closed three-way valve 545. The latter is connected to the source as indicated at 547 and has the two vacuum lines 177 from the gripper 29 connected thereto as indicated at 549. Valves 539 and 545 have air-operated pilots 551 and 553. Both these pilots are under control of a normally closed three-way valve 555 which is in turn under control of a four-way valve 557. The latter has a port *a* to which is connected an air supply line 559 from the manifold 351. Valve 555 is in a line 561 connected to port *b* of valve 557, the *c* port of valve 557 being plugged. Lines 561*a* and 561*b* branch from line 561 to pilots 551 and 553. Valve 557 has air-operated pilots 563 and 565. Pilot 563 is adapted to be supplied with air from manifold 351 via a line 567 including a normally closed three-way pushbutton valve 569 which is one of the series of valves on the rod 387, and which is located somewhat rearward of valve 533. Valve 569 is adapted for actuation by the cam 389 on the inserter carriage 127 as the inserter moves forward to supply air to pilot 563 which results in valve 557 being set to vent air from pilots 551 and 553 via lines 561*a*, 561*b* and 561 (valve 555 being open) thereby closing valves 539 and 545 to cut off vacuum in the suction cups 77 and grippers 29. Pilot 565 is adapted to be supplied with air from manifold 351 via line 441 and a line 571 including a normally open three-way pushbutton valve 573 mounted at the upper end of plate 109 in position for actuation by a beveled cam edge 575 at the other side of the upper end of bar 79 from cam edge 445 as the bar 79 reaches the upper end of its stroke. When valve 573 is so actuated by bar 79 (on raising the suction cups 77) is cuts off air to pilot 565. As bar 79 starts down (to lower the suction cups 77), valve 573 (being a normally open valve) opens to supply air to pilot 565. This shifts valve 557 to supply air to pilots 551 and 553 via lines 561, 561*a* and 561*b* (valve 555 being open) to open valves 539 and 545 for drawing a vacuum in the suction cups 77 and grippers 29. Valve 555 has an air-operated pilot 557, normally supplied with air from the manifold 351 via a line 579 including a three-way toggle valve 581 to keep valve 555 open. Valve 581 is adapted manually to be closed to close valve 555 to deactivate the apparatus, when so desired.

A cycle of operation of the apparatus may be regarded as starting when the series of interconnected liners 9 unwound from the roll 17 has been fed forward to the point where its leading (forward) end portion is hanging down in front of the liner grippers 29 at the forward ends of the bars or tines 125 of the inserter 27 with the leading end of the leading liner 9*a* of the series at the position illustrated in FIG. 2 wherein the beam of light from the lamp 237 has been cut off by the leading end portion of the liner 9*a* from the photocell 239. At this starting point of a cycle, the inserter 27 is in its retracted position of FIGS. 1, 2, 13 and 14. The upper jaw 251 of the first or rear clamping means 241 is open (raised). The second clamping means 243 is in its rearward retracted position, and it upper jaw 291 is open (raised) as shown in FIG. 27. The piston rod 111 of the bag opener cylinder 107 is up and bar 79 is raised, holding the suction cups 77 up with an opened bag 5 in place as shown in FIG. 2 ready to receive a liner. When the leading liner 9a interrupts the beam of light from lamp 237, the photocell 239 acts to energize the valve 455 to open it.

Air is thereby delivered via lines 453 and 495 to the pilot 491 of valve 473, thereby setting valve 473 to vent pilot 487 of the air-operated clutch 231 via line 483 to disengage the clutch and thereby stop the forward feed of the liners 9 by the liner feed belts 197 and 209, and to deliver air via line 471 to the valve 469 and, via the time delay 479, to the pilot 475 of valve 469. This sets valve 469 to deliver air to the pilot 467 of valve 457, thereby setting valve 457 to deliver air via lines 463 and 465 to the upper ends of the vertical cylinders 257 and 299 of the snap-off means 39, and to vent air from the lower ends of these cylinders via lines 468 and 466. The pistons 263 and 305 of cylinders 257 and 299 are thereupon driven downward simultaneously. Thus, the upper clamp jaw 251 of the rear clamp means 241 is driven down to clamp the second liner 9*b* slightly rearward of the line of weakness 19 between liners 9*a* and 9*b*, and the upper clamp jaw 291 of the forward clamp means 243 is driven down to clamp the leading liner 9*a* slightly forward of said line of weakness.

Figure 5:
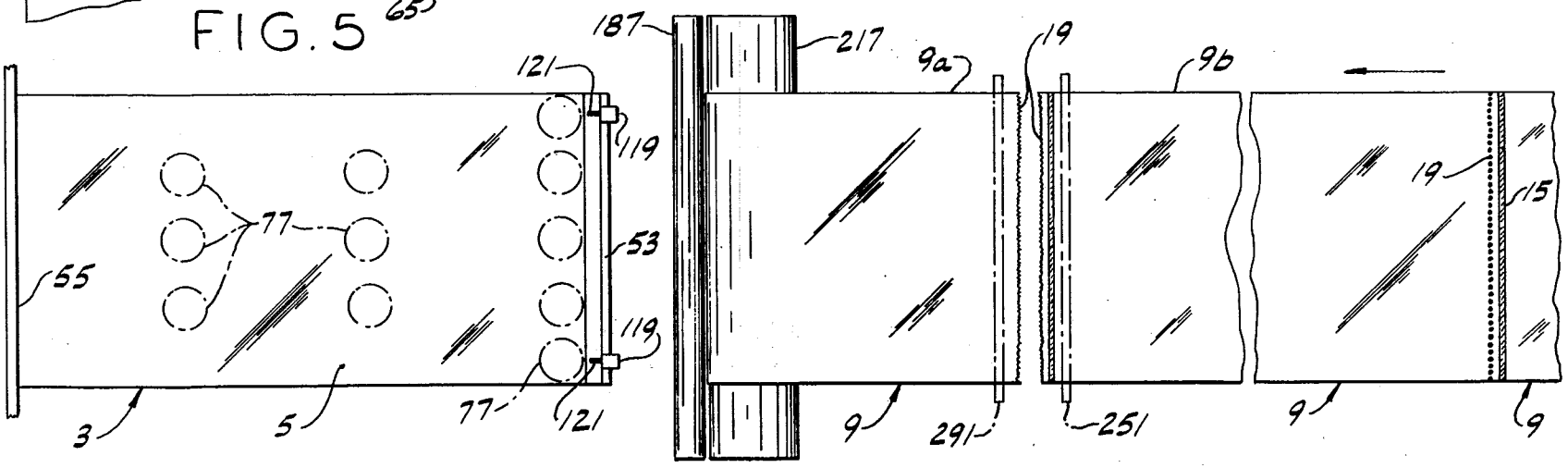
FIG. 5 is a semi-diagrammatic view in plan showing a stack of bags to be lined, and the snap-off of a liner to be inserted in a bag.

When the jaw 251 of the rear clamp means 241 comes down to clamp the second liner 9*b*, it opens the valve 283 (via engagement of screw 281 on head 277 with the button of this valve) to supply air via line 519 to the pilot 517 of valve 459. This sets valve 459 to deliver air via lines 509 and 511 to the rearward ends of the horizontal snap-off cylinders 307 and to vent the forward ends of these cylinders via lines 515 and 513, resulting in the forward clamp means 243 being driven forward away from the rear clamp means 241, with liner 9*a* clamped by the forward clamp means 243 ahead of the line of weakness 19 where 9*a* and 9*b* are initially joined and with liner 9*b* clamped by the rear clamp means 241 behind this line of weakness. As illustrated in FIG. 5, this snaps off liner 9*a* from liner 9*b* at the line of weakness (i.e., it tears 9*a* away from 9*b* at same line), thus separating liner 9*a* from the series of interconnected liners to enable its insertion in the opened bag 5. The jaws 251 and 291 stay down for a relatively brief interval as determined by the time delay unit 479, but sufficient for the snap-off of liner 9*a*; then pilot 467 of valve 457 is vented as previously described to reset valve 457 to return the jaws 251 and 291 to their raised retracted position.

Figure 30B:
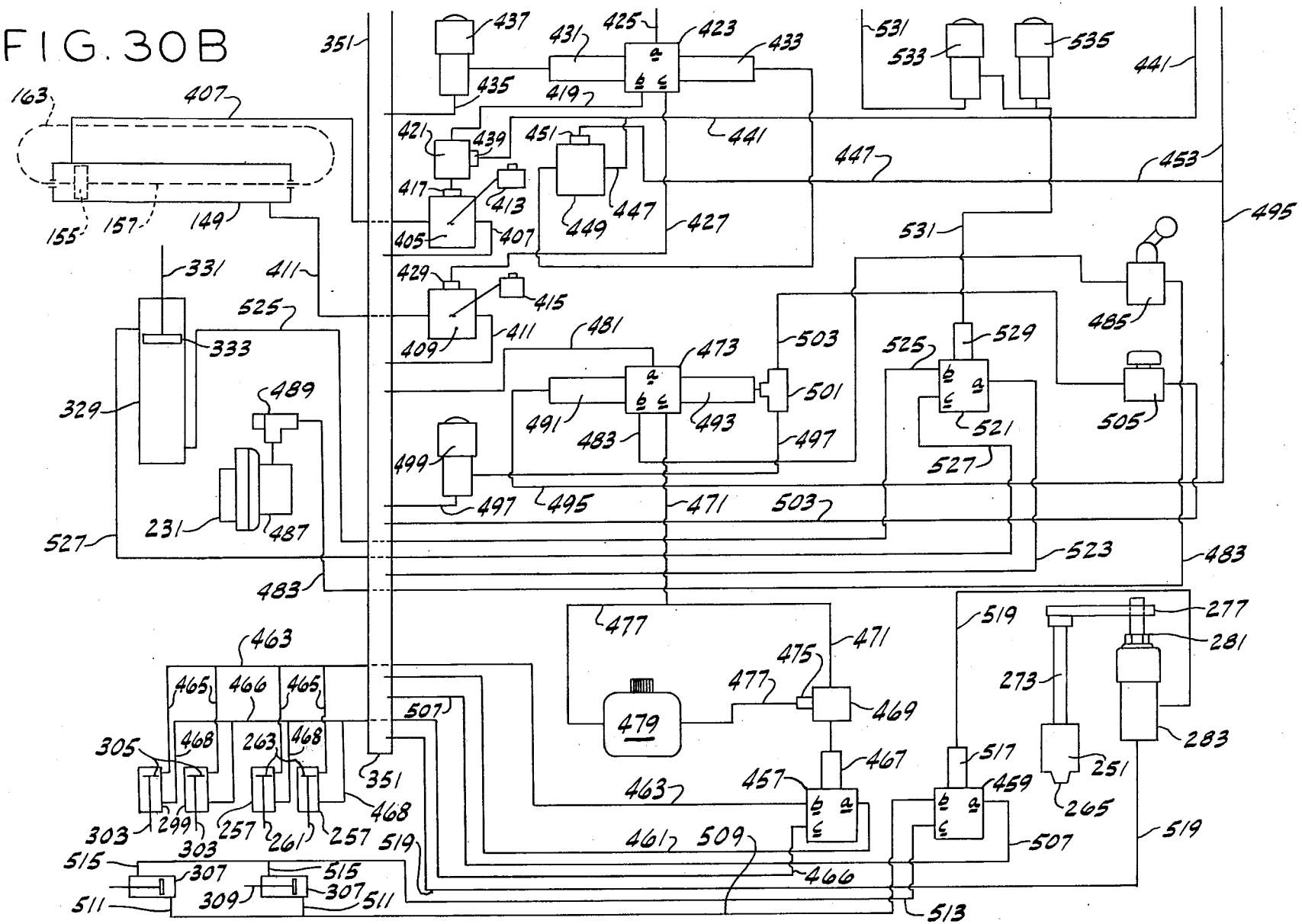

When the leading liner 9a is stopped as above described by the photocell 239 opening valve 455, air is also delivered via line 453 to the pilot 451 of valve 449. This actuates valve 449 to deliver air to pilot 433 of valve 423 via line 441 and line 447, noting that valve 443 in line 441 is open at this time due to bar 79 being raised with its cam edge 445 engaging the button of valve 443. On operation of pilot 433 valve 423 is set to deliver air via line 419 and valve 421 to pilot 417 of valve 405 thereby actuating valve 405 to supply air to the forward end of cylinder 149. Air is vented from the rearward end of this cylinder via line 411 and valves 409 and 415 and the piston 155 of cylinder 149 moves rearward from its forward position of FIGS. 13 and 30B, which is in effect its retracted position, to move the inserter 27 forward via the pull of cable 163.

As the inserter 27 moves forward, vacuum is applied to the vacuum gripper means 29 at the forward ends of the inserter bars 125 (applied to both the vacuum ports 171 and the suction cups 169) as a result of valve 573 being held open by the cam edge 575 on the upper end of bar 79 (which is raised). This supply of vacuum is via delivery of air by valve 573 through line 571 to pilot 565 of valve 557, setting valve 557 to deliver air to the pilot 553 of valve 545 via line 561 including valve 555 and line 561*b*, which holds valve 545 open for applying vacuum via lines 177 to the vacuum gripper means 29. Air is also delivered via lines 561 and 561*a* to the pilot 551 of valve 539, holding valve 539 open for applying vacuum to the bag opener suction cups 77 via 543 and 105.

Figure 2A:
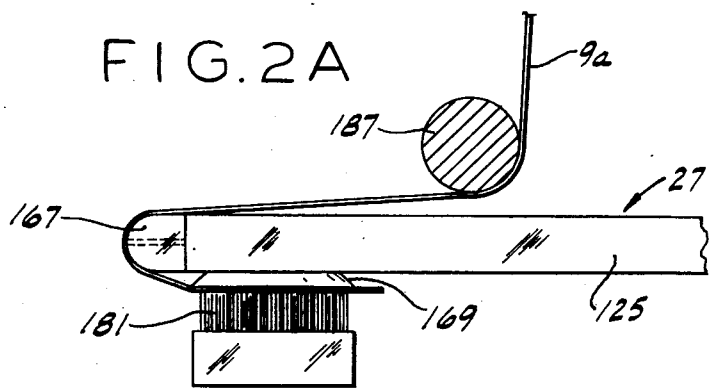
FIG. 2A is a fragment of FIG. 2 showing a moved position of parts.

With the vacuum on the gripping means 29, and the inserter 27 moving forward, the vacuum gripping heads or tips 167 of the gripping means engage the liner 9*a* at a point somewhat above its lower end as shown in FIG. 2 and vacuum-grip the liner 9*a* at that point. Continuing their forward movement, the vacuum heads or tips 167, gripping the liner 9*a*, carry it under the guide 187 and over the brush 181, causing the end portion of the liner to wrap under the tips and be gripped by the suction cups 169, as shown in FIG. 2A. This securely grips the closure end of the liner 9*a* to the forward ends of the inserter bars 125 and, on continued forward movement of the inserter 27, the liner 9*a* is inserted as shown in FIG. 3 in the opened bag 5 above the stack 3.

As the inserter 27 moves forward, the cam 389 on the inserter carriage 127 releases the valves 377 and 535 and shortly comes into engagement with the button of valve 499 and actuates this valve to supply air via line 497 to the pilot 493 of valve 473. This shifts valve 473 to deliver air via line 483 to the pilot 487 of the air-operated clutch 231, thereby engaging the clutch to effect driving of the belts 197 and 209 of the liner feed means 33 to feed forward the series of interconnected liners 9 from the roll 17. This forward feed of the liners continues until the leading end of the series of liners comes down between the lamp 237 and the photocell 239 to end the feed and start the next cycle.

As the inserter 27 moves farther forward, cam 389 engages the button of valve 569 and actuates this valve to supply air to the pilot 563 of valve 557. Valve 569 is adjusted in position on rod 387 in accordance with the length of bags 5 being handled for its actuation to occur generally at the point where the liner has been fully inserted in the opened bag, i.e., when the gripper tips 167 at the forward ends of bars 125 reach a position generally corresponding to the location of the guide 55 (which determines the position of the bottom closure ends 11 of the bags). Pilot 563 thereupon shifts valve 557 to vent line 561, with the result that valves 539 and 545 close to cut off vacuum in the bag opener suction cups 77 and also in the liner gripper heads or tips 167 (including ports 171 and suction cups 169). This frees the liner 9a (now inserted in the bag) from the inserter 27 so that the bag may be fed forward out of the apparatus by the outfeed means 35, as will appear, without having the liner 9a remain behind and the bag alone fed forward, and frees the bag.

The inserter 27 then moves farther forward, passing completely over the stack 3, and as the gripper tips 167 approach the forward or outfeed end of the apparatus, i.e., as the gripper tips approach the vertical plane of the outfeed rolls 313 and 315, cam 389 engages the button of valve 533 and actuates this valve to supply air via line 531 to the pilot 529 of valve 521, shifting the latter to supply air to the upper end of cylinder 329 via line 527 and venting its lower end via line 525 to retract (pull down) piston rod 331 of cylinder 329 thereby to bring the upper outfeed roll 313 down toward the lower outfeed roll 315 and pinch the bag with the liner therein in the nip of these rolls in the space between the inserter bars 125. The latter pass on by the rolls 313 and 315 and on opposite sides of the rolls. The rolls, being continuously driven in the outfeed direction, feed the bag with the liner therein forward (i.e., toward the left as viewed in FIGS. 1 and 4) off the inserter bars 125 and out of the apparatus to be stacked up in suitable manner.

The inserter bars 125 move forward to the forward limit of their stroke as indicated in FIG. 4, as determined by engagement of the cam 389 with the button of valve 437 on rod 387 (see FIG. 16), which actuates valve 437 to supply air to the pilot 431 of valve 423. This shifts valve 423 to supply air via line 427 to the pilot 429 of valve 409 and to vent the pilot 417 of valve 405, thereby supplying air via line 411 to the rear end of cylinder 149 and venting its forward end to drive the piston 155 forward thereby to drive the inserter 27 rearward to retracted position. As the inserter carriage 127 reaches its rearward retracted position, cam 389 actuates valves 535 and 377. Valve 535 thereupon vents pilot 529 of valve 521 to shift this valve to supply air via line 525 to the lower end of cylinder 329 and to vent air from the upper end of this cylinder via line 527, thereby extending (raising) piston rod 331 and returning roll 313 to its raised retracted position. Valve 377 supplies air via line 375 (assuming valve 379 is open in the presence of a bag or bags 5 on table 51) to the pilot 371 of valve 363. This shifts valve 363 to supply air via line 369 to the upper end of cylinder 107 and to vent the lower end of this cylinder via line 367, thereby extending piston rod 113 of cylinder 107 (driving it down) to lower the bag opener suction cups 77 into engagement with the uppermost bag 5 of the stack 3 on table 51.

As the suction cups 77 go down, i.e., as bar 79 goes down, the normally open valve 573 opens. This directs air via line 571 to the pilot 565 of valve 557, thereby shifting valve 557 to direct air via lines 561, **561*a* and 561*b* to pilots 551 and 553 of valves 539 and 545 to open valves 539 and 545 to draw a vacuum in the bag opener suction cups 77 (and in the vacuum gripper heads or tips 167 of the inserter 27). With vacuum on, the suction cups 77 go down into gripping engagement with the upper wall 23 of the uppermost bag 5 of the stack 3. Vacuum is quickly built up in the cups to grip the upper wall 23 of this bag and built up in the vacuum switch 395 to close this switch to energize solenoid valve 393. The latter thereupon supplies air via line 391 to pilot 373 of valve 363, shifting it to supply air via line 367 to the lower end of cylinder 107 and vent air from the upper end of this cylinder via line 369, thereby retracting piston rod 111 to raise the suction cups 77 and open the gripped bag in the manner illustrated in FIG. 2, for the next cycle of operation. All this occurs before the leading end of the series of liners 9 being fed forward by the liner conveyor belts 197 and 209 reaches the FIG. 2 position, and when the liners reach this position photocell 239 is blocked off from the beam from the lamp 237** to trigger the next cycle.

It will be observed that the bag opener suction cups 77 come down as soon as the inserter 27 is retracted to grip the upper wall 23 of the uppermost bag 5, and then rise to open the bag. Thus, there is no waiting for a bag to be delivered to the bag-opening position. Each successive bag 5 of the stack 3, as it becomes the uppermost bag of the stack, is immediately directly in position for being opened as soon as the inserter 27 is retracted. It will be further observed that the liner feed means 33 is started to feed the series of liners 9 forward shortly after the inserter 27 starts its forward movement, and continues in operation to feed the series forward until stopped by the leading end of the series coming down in front of the tips 167 of the inserter. Thus, the forward feed of the series occurs mainly during the forward and return stroke of the inserter, with the final phase of the forward feed of the series occurring after the inserter has been retracted, and the waiting for a liner to be delivered into position for being gripped by the inserter is minimized.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for inserting liners in open-mouth bags, each liner being an open-mouth bag having a bottom end closure at the opposite end from the mouth, said apparatus comprising:

means for holding a stack of bags with the bags in the stack extending longitudinally of the apparatus and with the mouths of the bags in the stack directed toward one end of the apparatus constituting its rearward end;

means for gripping the upper wall of the uppermost bag of the stack and raising it to open said bag for insertion of a liner therein;

an inserter movable forward longitudinally of the apparatus from a rearward retracted position wherein its foward end is rearward of the mouth of the opened bag through a forward stroke above said stack holding means for entry of the inserter in the opened bag to insert a liner therein and for movement of said bag with the liner therein to an outfeed position wherein the forward end portion of the bag is forward of the stack;

said inserter having means for gripping a liner for forward movement of the liner with the inserter into the opened bag;

means for moving the inserter longitudinally of the apparatus through a forward stroke from its retracted position and then through a rearward return stroke back to its retracted position;

means for feeding a liner from a supply thereof to bring the liner into position for being gripped by said liner gripping means for insertion of the liner in said opened bag;

means for operating the liner gripping means to grip said liner and for releasing the grip after insertion of the liner; and outfeed means forward of the stack holding means engageable with a lined bag in the outfeed position for feeding the lined bag forward.

2. Apparatus as set forth in claim 1 wherein the means for gripping the upper wall of the uppermost bag of the stack is located above the stack holding means and movable downwardly from a raised retracted position above the stack into engagement with the upper wall of the uppermost bag of the stack and then upwardly while gripping the upper wall of said bag to open it, said bag wall gripping means when in its raised retracted position being spaced from said stack holding means a distance greater than the height of the stack and being movable downwardly through a distance greater than said height for engagement with successive bags of the stack.

3. Apparatus as set forth in claim 2 having means engageable by the lower wall of the uppermost bag at its mouth as the upper wall of said bag is raised for holding down said lower wall at the bag mouth while the upper wall is raised to open the bag.

4. Apparatus as set forth in claim 3 wherein said means for gripping the upper wall of the uppermost bag comprises suction cup means, an air cylinder for moving said suction cup means up and down with a stroke greater than the height of the stack so that said suction cup means may be lowered into engagement with successive bags of the stack, and means for drawing a vacuum in said suction cup means for gripping said upper wall.

5. Apparatus as set forth in claim 4 having means responsive to return of the inserter to its retracted position for lowering said suction cup means to grip the upper wall of the uppermost bag and then raising said suction cup means to open the uppermost bag.

6. Apparatus as set forth in claim 5 having means responsive to raising of said suction cup means for controlling operation of said inserter moving means to move the inserter forward.

7. Apparatus as set forth in claim 6 having means operable by the inserter at the end of its forward stroke for operating said inserter moving means to return the inserter to its retracted position.

8. Apparatus as set forth in claim 7 wherein said outfeed means comprises feed means movable from a retracted position into engagement with a lined bag in the outfeed position, and means operable by the inserter toward the end of its forward stroke for moving said feed means into engagement with said lined bag to feed it forward.

9. Apparatus as set forth in claim 8 having means responsive to feeding of a liner into position for being gripped by said liner gripping means for controlling operation of said inserter moving means to move the inserter forward.

10. Apparatus as set forth in claim 9 having means for deactivating the apparatus when the last bag of a stack has been lined and fed out of the apparatus.

11. Apparatus as set forth in claim 1 wherein liners are supplied from a roll of liners in which liners are interconnected end-to-end in series at transverse lines of weakness each defining the mouth end of a liner and the bottom end of the next liner, and wherein said means for feeding the liners feeds them forward with the closure ends of the liners leading and their mouth ends trailing and includes means for snapping off the leading liner.

12. Apparatus as set forth in claim 11 wherein said liner gripping means is at the forward end of the inserter, and said feeding means feeds the leading end of the leading liner, which is its closure end, downwardly in front of the forward end of the inserter for gripping of the closure end portion of said liner by said liner gripping means as the inserter starts moving forward.

13. Apparatus as set forth in claim 12 wherein said liner gripping means comprises vacuum grip means at the forward end of the inserter and on the bottom of the inserter adjacent its forward end, said apparatus having means for causing the leading end of the liner to become folded around the forward end of the inserter and under the bottom vacuum grip means.

14. Apparatus as set forth in claim 13 wherein said bottom vacuum grip means comprises suction cup means.

15. Apparatus as set forth in claim 12 wherein said means for snapping off the leading liner comprises a first clamping means for clamping the series of liners rearward of the line of weakness between the leading liner and the next liner, and second clamping means for clamping the leading liner forward of said line of weakness, said second clamping means being movable forward away from the first clamping means to snap off the leading liner from the next liner.

16. Apparatus as set forth in claim 15 wherein said first and second clamping means are carried by a support adjustable longitudinally of the apparatus for operation on liners of different lengths.

17. Apparatus for inserting liners in open-mouth bags, each liner being an open-mouth bag having a bottom end closure at the opposite end from the mouth, said apparatus comprising:

a table for holding a stack of bags with the bags in the stack in generally horizontal position extending longitudinally of the apparatus and with the mouths of the bags directed toward one end of the apparatus constituting its rearward end;

means on the table for locating the stack in predetermined position longitudinally and transversely relative to the apparatus;

vacuum grip means movable downwardly from a raised retracted position above the table into engagement with the upper wall of the uppermost bag of a stack positioned on the table and then movable upwardly while gripping said upper wall to open the bag and lift it above the stack for insertion of a liner therein;

means for raising the lowering said vacuum grip means;

an inserter comprising a carriage and a pair of bars extending forward from the carriage in side-by-side spaced relation movable forward longitudinally of the apparatus generally in the horizontal plane of the opened bag from a rearward retracted position wherein the forward ends of the bars are rearward of the mouth of the opened bag through a forward stroke above the table for entry of the bars in the opened bag to insert a liner therein and for forward movement of the bag with the liner therein to an outfeed position wherein the forward end portion of the bag is forward of the stack;

vacuum grip means at the forward ends of the bars for gripping a liner for forward movement of the liner with the bars into the opened bag;

means for moving the carriage to move the carriage and said bars longitudinally of the apparatus through a forward stroke from the retracted position and then through a rearward position return stroke back to retracted position;

means for holding a roll of liners in which the liners are interconnected end-to-end in series at transverse lines of weakness each defining the mouth end of a liner and the bottom end of the next liner;

means for feeding the liners forward and bringing the leading end of the leading liner downwardly in front of the forward ends of said bars;

means for snapping off the leading liner;

means for drawing a vacuum in the liner vacuum grip means to grip the snapped-off liner and for cutting off the vacuum after insertion of the liner; and outfeed means forward of the table engageable with a lined bag in the outfeed position between said bars for feeding the lined bag forward.

18. Apparatus as set forth in claim 17 wherein the means for raising and lowering the vacuum grip means for the bags is operable to lift said vacuum grip means to a raised retracted position spaced from the table a distance greater than the height of a stack and to move said vacuum grip means down far enough to grip the last bag of a stack.

19. Apparatus as set forth in claim 18 having means engageable by the lower wall of the uppermost bag at its mouth as the upper wall of said bag is raised for holding down said lower wall at the bag mouth while the upper wall is raised to open the bag.

20. Apparatus as set forth in claim 19 having means operable by the inserter on its return to retracted position for operating the bag raising and lowering means to lower the bag vacuum grip means to grip the upper wall of the uppermost bag and then raise it to open the uppermost bag.

21. Apparatus as set forth in claim 20 having means responsive to raising of the bag vacuum grip means for controlling operation of said carriage moving means to move the carriage forward.

22. Apparatus as set forth in claim 21 having means responsive to movement of the carriage to the end of its forward stroke for operating the carriage moving means to return the carriage to retracted position.

23. Apparatus as set forth in claim 22 wherein said outfeed means comprises a pair of rolls relatively movable toward and away from one another to grip a lined bag between said bars, said apparatus having means for relatively moving the rolls to grip a lined bag in response to movement of the carriage to the end of its forward stroke.

24. Apparatus as set forth in claim 23 having means responsive to feeding of the leading end of the leading liner downwardly in front of the forward ends of said bars for actuating said snap-off means and controlling operation of said means for moving the carriage to move the carriage forward.

25. Apparatus as set forth in claim 24 wherein the vacuum grip means at the forward ends of the bars comprises a tip on the forward end of each bar having vacuum ports extending rearward therefrom for gripping the downwardly extending leading end of the leading liner and a suction cup on the bottom of the bar, and wherein the apparatus has means for causing the leading end of the liner to become folded around the tips and under the suction cups.

26. Apparatus as set forth in claim 24 wherein said means for snapping off the leading liner comprises a first clamping means for clamping the series of liners rearward of the line of weakness between the leading liner and the next liner, and second clamping means for clamping the leading liner forward of said line of wekeness, said second clamping means being movable forward away from the first clamping means to snap off the leading liner from the next liner.

27. Apparatus as set forth in claim 26 wherein said first and second clamping means are carried by a support adjustable longitudinally of the apparatus for operation on liners of different lengths.

* * * * *